US011105550B2

(12) United States Patent
Kim et al.

(10) Patent No.: US 11,105,550 B2
(45) Date of Patent: Aug. 31, 2021

(54) REFRIGERATOR

(71) Applicant: LG ELECTRONICS INC., Seoul (KR)

(72) Inventors: Yongnam Kim, Seoul (KR); Minkyu Oh, Seoul (KR); Yanghwan No, Seoul (KR); Seongwoo An, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 216 days.

(21) Appl. No.: 16/515,515

(22) Filed: Jul. 18, 2019

(65) Prior Publication Data

US 2020/0041197 A1 Feb. 6, 2020

(30) Foreign Application Priority Data

Jul. 31, 2018 (KR) ..... 10-2018-0089388

(51) Int. Cl.

| | |
|---|---|
| ***F25D 23/10*** | (2006.01) |
| ***F25D 13/00*** | (2006.01) |
| ***F25D 17/06*** | (2006.01) |
| ***F25D 23/02*** | (2006.01) |
| ***F25D 23/06*** | (2006.01) |

(52) U.S. Cl.

CPC ..... *F25D 23/10* (2013.01); *F25D 13/00* (2013.01); *F25D 17/06* (2013.01); *F25D 23/02* (2013.01); *F25D 23/06* (2013.01)

(58) Field of Classification Search

CPC ..... F25D 23/10; F25D 13/00; F25D 23/02; F25D 23/06; F25D 2317/0661; F25D 2317/0665; F25D 23/003; F25D 23/069; A47B 77/08

USPC ..... 62/263, 261

See application file for complete search history.

(56) References Cited

U.S. PATENT DOCUMENTS

| | | | | |
|---|---|---|---|---|
| 5,505,046 | A * | 4/1996 | Nelson | F25B 21/02 62/3.6 |
| 2008/0127456 | A1 | 6/2008 | Maunsell et al. | |
| 2018/0016013 | A1 | 1/2018 | Burd et al. | |

FOREIGN PATENT DOCUMENTS

| | | | |
|---|---|---|---|
| DE | 19745090 | A1 | 4/1999 |
| DE | 102007056272 | A1 | 5/2008 |
| JP | 2007260212 | A | 10/2007 |
| KR | 10-0569935 | A | 4/2006 |

* cited by examiner

*Primary Examiner* — Ana M Vazquez
(74) *Attorney, Agent, or Firm* — Dentons US LLP

(57) ABSTRACT

A refrigerator may be installed in a storage space defined by a wall of an object and includes a contact mechanism to bring the refrigerator into contact with the wall.

20 Claims, 24 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2018-0089388 (filed on Jul. 31, 2018), which is hereby incorporated by reference in its entirety.

BACKGROUND

The present disclosure relates to a refrigerator which may be driven with low noise by having a thermoelectric device module.

A thermoelectric device refers to a device that implements heat absorption and heat generation using Peltier effect. The Peltier effect refers to an effect of causing an endothermic phenomenon on one side surface of the thermoelectric device and an exothermic phenomenon on the other side surface thereof according to the direction of a current when a voltage is applied to both ends of the thermoelectric device. This thermoelectric device may be used in a refrigerator instead of a freezing cycle device.

Generally, a refrigerator is an apparatus which stores food for a long period of time without deterioration by having a food storage space capable of blocking heat penetrating from the outside by a cabinet and a door filled with insulation material therein, providing a freezing device including an evaporator for absorbing heat inside the food storage space and a heat dissipating device for discharging the collected heat to the outside of the food storage space, and keeping the food storage space at a temperature region having a low temperature where the microorganisms cannot survive and proliferate.

The refrigerator may be divided into a refrigerating chamber for storing food in a temperature region of above zero (0) and a freezing chamber for storing food in a temperature region of below zero, and, according to a disposition of the refrigerating chamber and the freezing chamber, divides into a top freezer refrigerator which has an upper freezing chamber and a lower refrigerating chamber, a bottom freezer refrigerator which has a lower freezing chamber and an upper refrigerating chamber, a side by side refrigerator which has a left freezing chamber and a right refrigerating chamber or the like.

In addition, the refrigerator may have a plurality of shelves, a plurality of drawers, and the like in the food storage space so that the user may conveniently store or draw out food stored in the food storage space.

Meanwhile, a built-in refrigerator refers to a refrigerator that is embedded, for example, in furniture, walls, or the like when the building is first built. While general refrigerators are installed in opened spaces, the built-in refrigerators are embedded in furniture, walls, or the like. Therefore, the built-in refrigerator is more vulnerable to heat dissipation than the general refrigerator.

The Applicant has filed an application in the Republic of Korea and which has been registered as follows, with respect to a built-in refrigerator.

1. Registration patent number (Registration date): No. 10-0569935 (Apr. 4, 2006)

2. Title of invention: Heat-dissipating structure of built-in refrigerator

According to the patent document, air is suctioned through a bottom surface of the refrigerator in a machine chamber, and the air is again discharged to a rear of the refrigerator. Air discharged to the rear of the refrigerator is raised by natural convection.

However, since the machine chamber is generally installed at the lower end of the refrigerator, the hot air discharged to the rear of the refrigerator affects the entire rear surface of the refrigerator. The air rising due to natural convection constantly meets the entire area of the rear of the refrigerator. This may adversely affect the insulation load and performance required in the refrigerator.

In addition, the air discharged to the rear of the refrigerator may not rise and may be re-suctioned back into the machine chamber. Especially, in a case where the left and right side surfaces of the refrigerator are shielded like the built-in refrigerator, there is a high possibility that the hot air is re-suctioned back into the machine chamber.

In addition, there may be a problem that noise generated in the refrigerator increases due to the driving of a compressor.

Meanwhile, there may be a problem that the refrigerator may not be stably installed in the built-in furniture.

SUMMARY

So as to solve the problem, one aspect is to provide a compact built-in refrigerator which is capable of reducing noise. In particular, one aspect is to provide a refrigerator having a structure in which a storage chamber is cooled by a thermoelectric device module and a heat dissipating flow is formed by using a fan provided in the thermoelectric device module.

In addition, one aspect is to provide a refrigerator which may easily cool a stored product stored close to a side of a door by extending a supply duct for supplying cool air to the storage chamber from a rear wall of the cabinet toward a side of the door to be lengthened to the front.

In addition, one aspect is to provide a refrigerator which may keep the temperature of the storage chamber low, even if the refrigerator is moved from the built-in-place thereof to another place so that the stored product of the refrigerator is not damaged during the moving process. In particular, one aspect is to provide a refrigerator in which a cold storage agent is disposed in the supply duct, and thus the temperature of the storage chamber may be kept low even if cool air is not supplied by a cooling device when the refrigerator is moved.

In addition, one aspect is to provide a refrigerator which may easily cool the storage chamber by heat-exchanging the cool air in the storage chamber with the endothermic heat sink of the thermoelectric device module and supplying the heat exchanged cool air to the storage chamber through the cool air circulation fan. In particular, the cool air circulation fan is provided on the rear wall of the cabinet and the cool air passing through the cool air circulation fan is supplied from the rear wall, the upper portion, and lower portion of the cabinet to the storage chamber, and thus the cool air may be effectively supplied.

In addition, one aspect is to provide a refrigerator which may easily dissipate the heat of a refrigerator by providing an outdoor air circulation fan for forcibly introducing and discharging the outdoor air. One aspect is to provide a refrigerator which may facilitate heat exchange with an exothermal heat sink of the thermoelectric device module by disposing a heat dissipating duct in an outer space of the storage chamber to circulate the outdoor air.

In addition, one aspect is to provide a refrigerator which enables a built-in refrigerator to be stably installed by the built-in refrigerator being in compact with a relative object (for example, furniture, or the like).

A refrigerator according to the embodiment of the present invention is a refrigerator installed in a storage space defined by a wall of an object to be installed and includes a contact mechanism to bring the refrigerator into contact with the wall, so that the refrigerator may be stably installed.

The refrigerator further includes a cabinet having an inner case forming a storage chamber, an outer case surrounding the inner case, and a cabinet insulation material disposed between the inner case and the outer case; and a door disposed in front of the cabinet, the door to open and close the storage chamber.

The refrigerator further includes a supply duct installed in the inner case, the supply duct to discharge cool air to the storage chamber; and a cool air circulation fan installed at one side of the supply duct, the cool air circulation fan to generate circulation of the cool air, so that the cool air may be smoothly circulated.

The refrigerator includes a heat dissipating duct installed in the cabinet insulation material, the heat dissipating duct to introduce or discharge outdoor air; and a heat dissipating fan installed at one side of the heat dissipating duct, the heat dissipating fan to generate a flow of the outdoor air, so that the outdoor air may be smoothly circulated.

The contact mechanism includes a lever movably provided, a disk rotating along the movement of the lever, and a contact member linearly moving based on the rotation of the disk to be in contact with the wall, so that the contact mechanism is easily in contact with the wall of the refrigerator.

The contact mechanism is disposed on the upper side of the cabinet so that the user may easily operate the lever.

The contact mechanism further includes a housing in which the disk is installed and an insertion portion formed on the housing and in which the contact member is drawn in or drawn out.

The housing includes a housing front portion and a housing side portion extending rearward from both sides of the housing front portion, and the insertion portion may be formed on the housing side portion.

The housing further includes a housing upper portion connected to the housing side portion, and the lever is disposed on the upper portion or the front portion of the housing so that the user may easily access the lever.

The refrigerator further includes a link rotatably provided so as to be interlocked with the movement of the lever, so that power may be easily transmitted to the contact member.

The refrigerator further includes a first elastic member coupled to the lever to provide a restoring force, so that the lever may be easily returned to the original position.

The lever may be linearly moved forward or backward, and the contact member protrudes from the housing in a lateral direction and may be in contact with the wall so that the refrigerator may be easily fixed to the object to be installed.

The contact mechanism may be installed inside the outer case.

The contact mechanism further includes a stopper mechanism for restricting the movement of the lever, so that the refrigerator may be easily installed and the refrigerator may be stably supported in a state where the refrigerator is installed in the storage space.

The refrigerator further includes a thermoelectric device module installed at a rear wall of the storage chamber, the thermoelectric device module including an endothermic heat sink exchanging heat with the cool air and an exothermal heat sink exchanging heat with the outdoor air, so that it may easily generate cool air with low noise.

The refrigerator further includes a cold storage agent which is installed in the supply duct and cooled by cool air flowing through the supply duct, so that the coolness of the cool air may be kept.

The object to be installed may include furniture.

According to the embodiments described above, the generation of cool air and heat dissipation may be performed using the thermoelectric device module, so that noise generated in the refrigerator may be reduced.

In addition, since the supply duct for supplying cool air to the storage chamber may be extended from the rear wall of the cabinet toward the side of the door to be lengthened to the front side and thus may be positioned to be close to the side of the door so that the storage chamber may be cooled evenly.

In addition, by disposing the cold storage agent in the supply duct, the temperature of the storage chamber may be kept low even if the cool air is not supplied from the cooling device when the refrigerator is moved.

In addition, the cooling air in the storage chamber exchanges heat with the endothermic heat sink of the thermoelectric device module, and the heat exchanged cool air is supplied to the storage chamber through the cool air circulation fan so that the storage chamber may be easily cooled. In particular, the cool air circulation fan is provided at the rear wall of the cabinet, and the cool air passing through the cool air circulation fan is supplied from the rear wall, the upper portion, and lower portion of the cabinet to the storage chamber, and the cool air may be efficiently supplied.

In addition, the outdoor air circulation fan which forces the introduction and the discharge of the outdoor air is provided, so that the heat of the refrigerator may be easily dissipated. By disposing a heat dissipating duct in outer space of the storage chamber and circulating the outdoor air, heat exchange with the heat dissipating heat sink of the thermoelectric device module may be facilitated.

In addition, there is an advantage that the refrigerator may be installed stably by providing the contact mechanism on the upper portion of the refrigerator, and the refrigerator is installed in the storage space of the relative object such as furniture and then is in contact with the wall of the relative object.

Even if there is a concern that the distance between the outer surface of the refrigerator and the wall is relatively large and thus the refrigerator may be shaken, the contact mechanism may protrude from the outer surface of the refrigerator and contact the wall, and thus this concern may be dispelled.

In addition, the contact mechanism is provided with a rotatable disk, rotation of the disk is caused by a lever operation of the user, and the rotational motion is converted into the linear motion of the contact member, and thus there is an advantage that the contact may be formed between the contact member and the wall of the furniture.

In addition, the lever is provided with the engaging member, and the user operates the lever to contact the refrigerator and the wall of the furniture or the like, and then the engaging member is hooked to the rack so that the contact portion of the refrigerator may be prevented from being moved.

In addition, since the contact mechanism may be provided inside the outer case of the refrigerator, an outer appearance of the refrigerator may be made pleasing.

In addition, since the lever provided to the contact mechanism may be provided on the front portion or the top portion of the contact mechanism housing, the user's operating convenience may be improved.

DETAILED DESCRIPTION OF THE EMBODIMENTS

Figure 1:
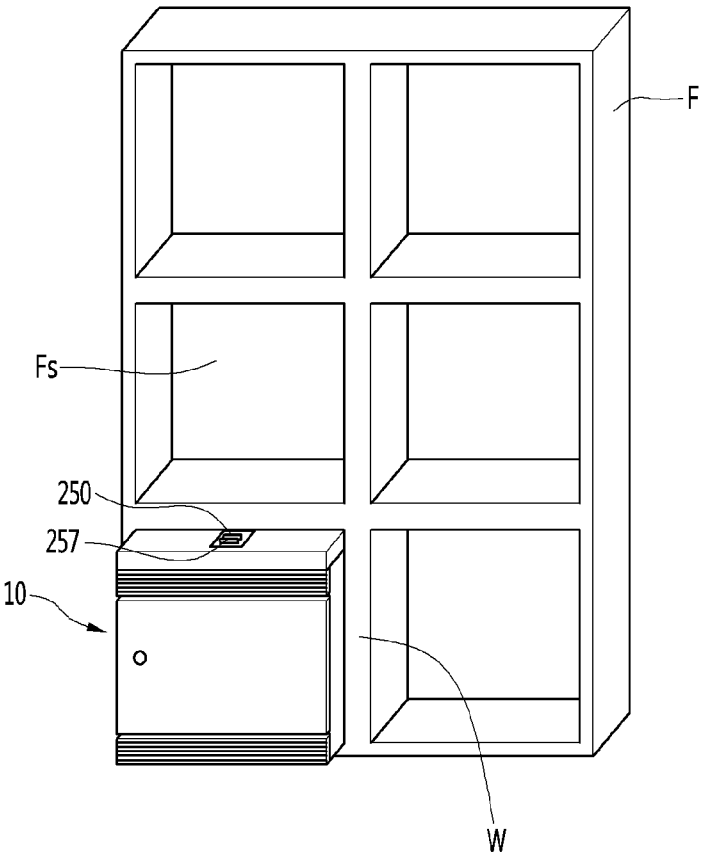
FIG. 1 is a view illustrating a state where a refrigerator according to a first embodiment of the present invention is built-in into a furniture.

Hereinafter, some embodiments of the present invention will be described in detail with reference to exemplary drawings. It should be noted that, in adding reference numerals to the constituent elements of the drawings, the same constituent elements may be denoted by the same reference numerals even though they are illustrated in different drawings. In addition, in the following description of the embodiments of the present invention, a detailed description with respect to known configurations or functions incorporated herein may be omitted in a case where it is determined that the understanding thereof is obstructed.

Also, terms such as first, second, A, B, (a), (b) or the like may be used herein when describing components of the embodiments of the present invention. These terms are intended only to distinguish the components from the other components and are not limit an essence, order, sequence, or the like of a corresponding component. It should be understood that if it is described in the specification that one component is "connected," "coupled", or "joined" to another component, the one component may be directly connected, coupled, or joined to the another component, but another component may be "connected", "coupled", or "joined" between components.

Figure 2:
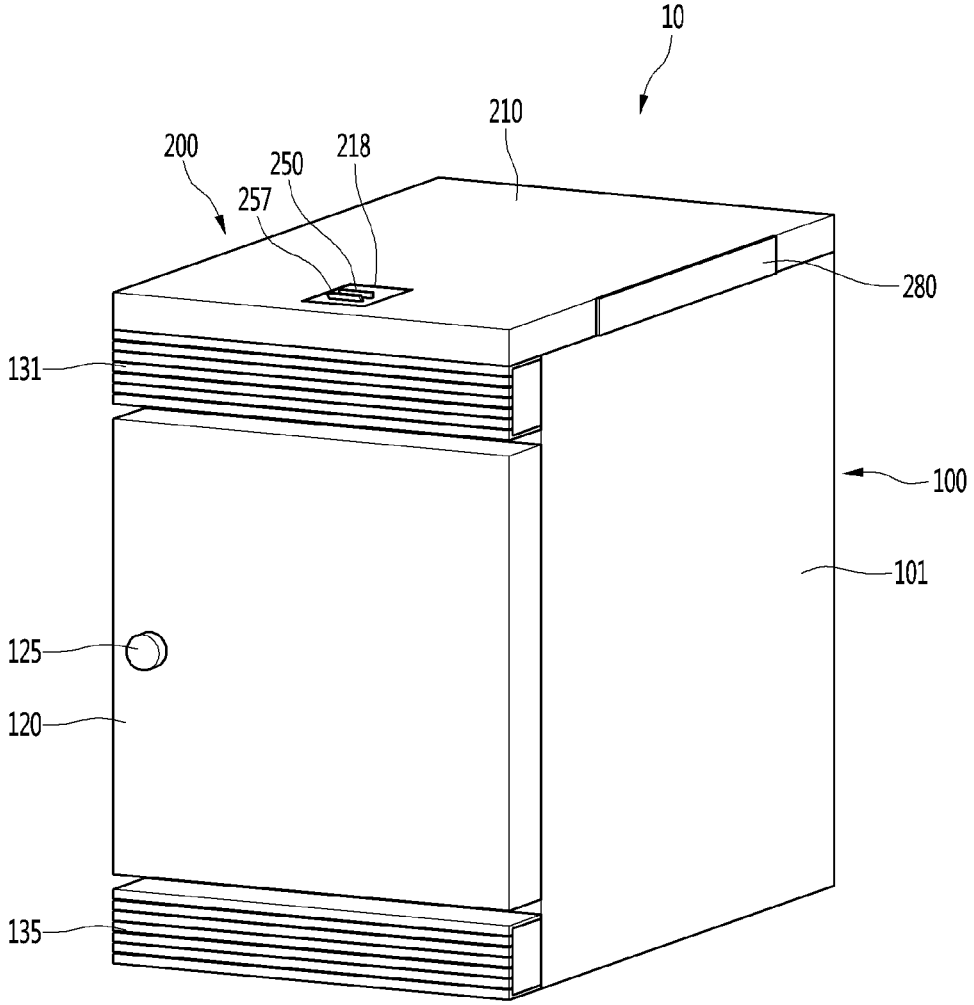
FIG. 2 is a view illustrating a configuration of the refrigerator according to the first embodiment of the present invention.
Figure 3:
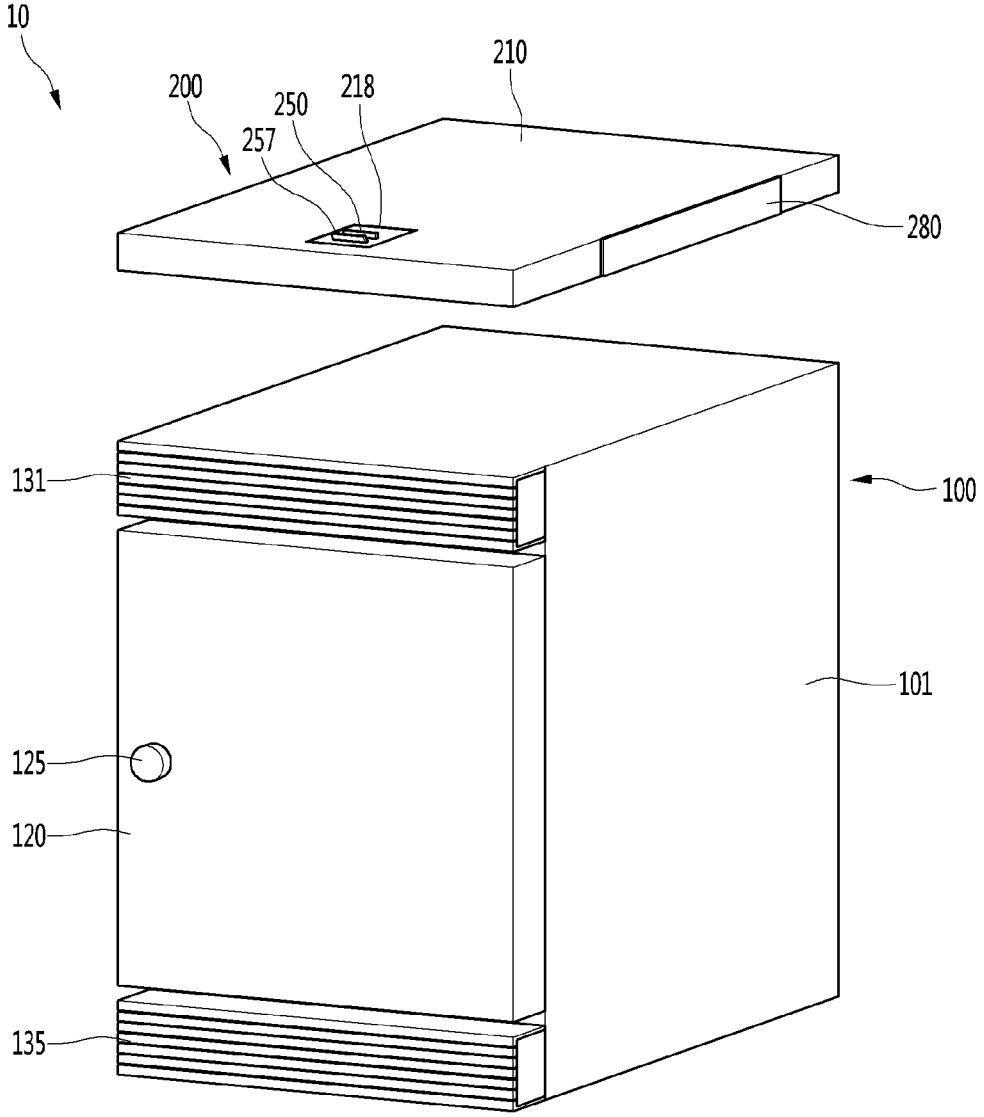
FIG. 3 is an exploded perspective view illustrating the configuration of the refrigerator according to the first embodiment of the present invention.

FIG. 1 is a view illustrating a state where a refrigerator according to a first embodiment of the present invention is built-in into a furniture, FIG. 2 is a view illustrating a configuration of the refrigerator according to the first embodiment of the present invention, and FIG. 3 is an exploded perspective view illustrating the configuration of the refrigerator according to the first embodiment of the present invention.

First, referring to FIG. 1, the refrigerator 10 according to the first embodiment of the present invention may be housed in a storage space defined by a wall of an object to be installed. The refrigerator 10 may be understood as a built-in refrigerator which is installed by being embedded in a wall or furniture of a home or office. For example, FIG. 1 illustrates a state where the refrigerator 10 is installed in a storage space Fs formed in an object to be installed, that is, furniture F.

The refrigerator 10 may be installed by being fixed to the furniture F or may be detachably installed. In other words, the refrigerator 10 is a portable refrigerator, and while the refrigerator 10 is normally used in a state of being inserted into the storage space Fs of the furniture F, the refrigerator 10 is detachable from the furniture F and may be carried and used such as an ice box when there is an event such as a picnic. An outer surface of the refrigerator 10 may be positioned adjacent to a wall W of the furniture F.

The refrigerator 10 may be configured to have a relatively small size and a light weight so as to facilitate the carrying by the user. For example, the refrigerator 10 may be formed in a dimension of 330 to 50 cm in width, length, and height and a weight of 10 to 15 kg or less.

The refrigerator 10 includes a refrigerator main body in which a food storage space is formed, and a contact mechanism 200 provided on an upper side of the refrigerator main body. For example, the contact mechanism 200 may be installed on an outer side of an outer case 101.

The refrigerator main body includes a cabinet 100 for forming a storage chamber and a door 120 for shielding the storage chamber. The refrigerator main body may be provided with inlet and outlet grilles 131 and 135 which are disposed on upper and lower sides of the door 120 to allow outdoor air to flow in and out.

The contact mechanism 200 includes a housing 210 which is seated on an upper side of the cabinet 100. The housing 210 has a substantially hexahedral shape, and a power transmission element for moving a contact member 280 may be included in the housing 210. The contact member 280 may be disposed on both side surfaces of the housing 210.

A cutout portion 218 is formed on an upper portion of the housing 210 in which a lever 250 is installed. The cutout portion 218 includes a through-hole formed through an upper surface of the housing 210. The lever 250 protrudes upward from the cutout portion 218.

The user may move the lever 250 forward or backward to cause the contact member 280 to be drawn out from the side surface of the housing 210 in a lateral direction or drawn in the opposite direction thereof according to the movement of the lever 250.

Figure 4:
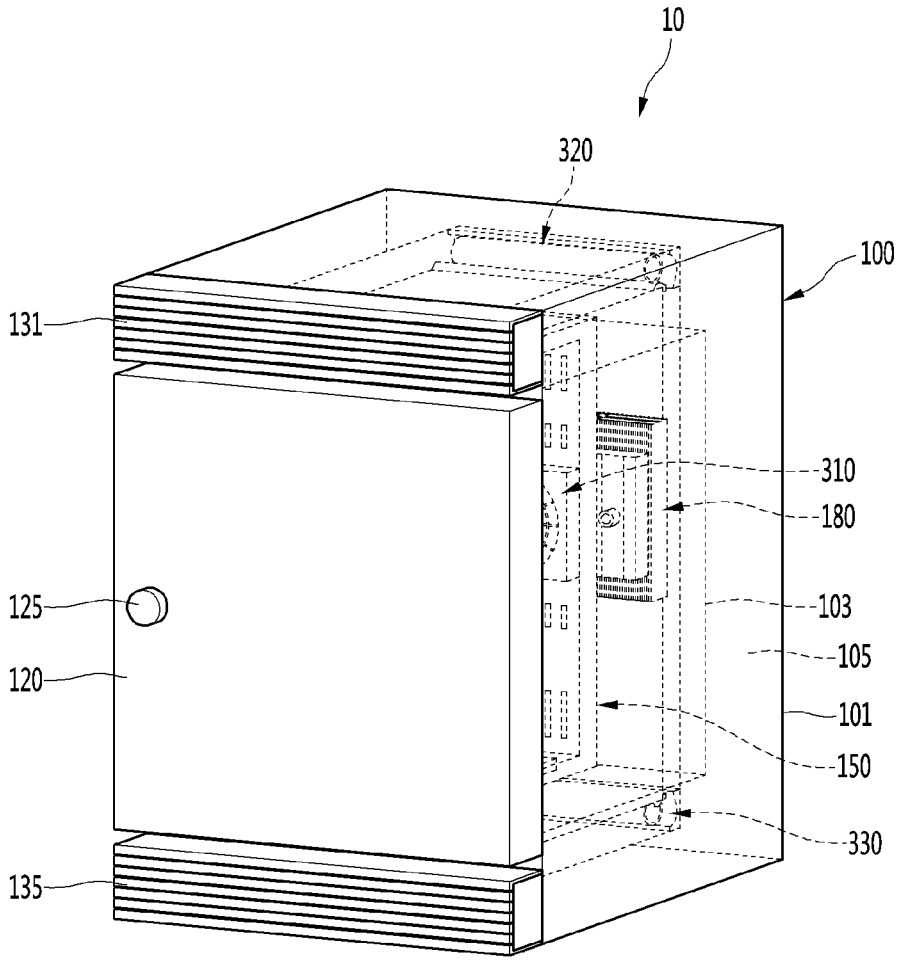
FIG. 4 is a perspective view illustrating a main body configuration of the refrigerator according to the first embodiment of the present invention.
Figure 5:
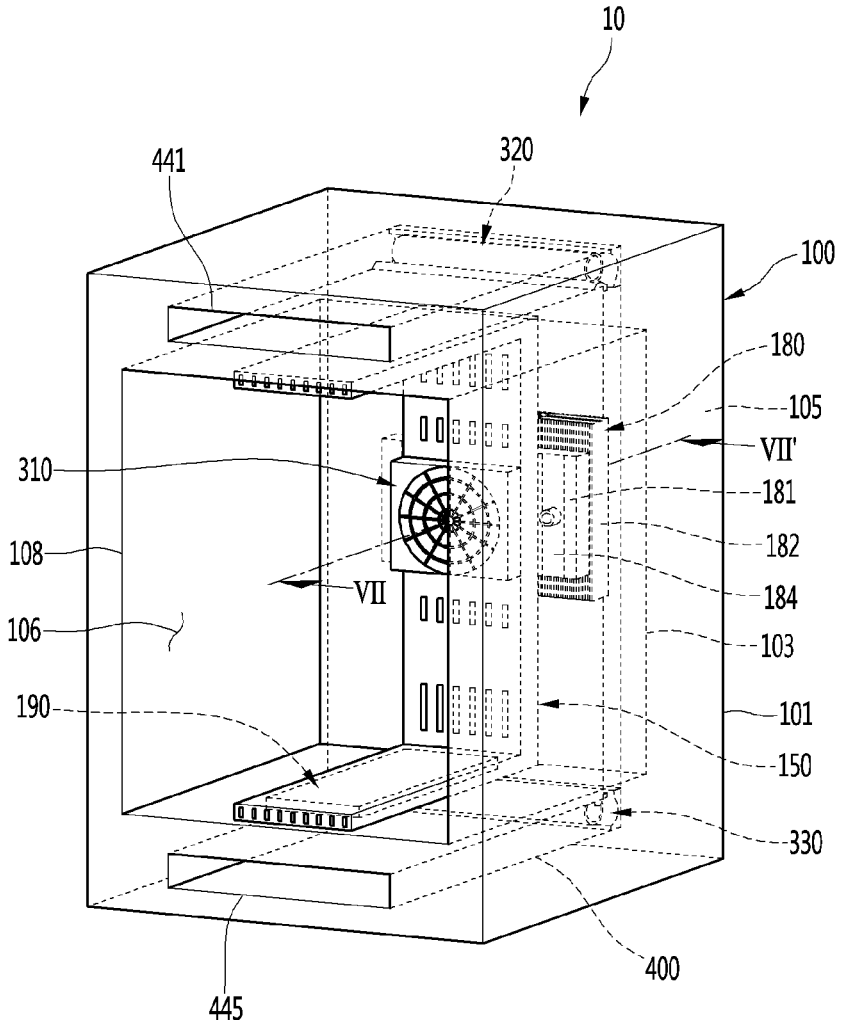
FIG. 5 is a view illustrating an internal configuration of the main body of the refrigerator according to the first embodiment of the present invention.
Figure 6:
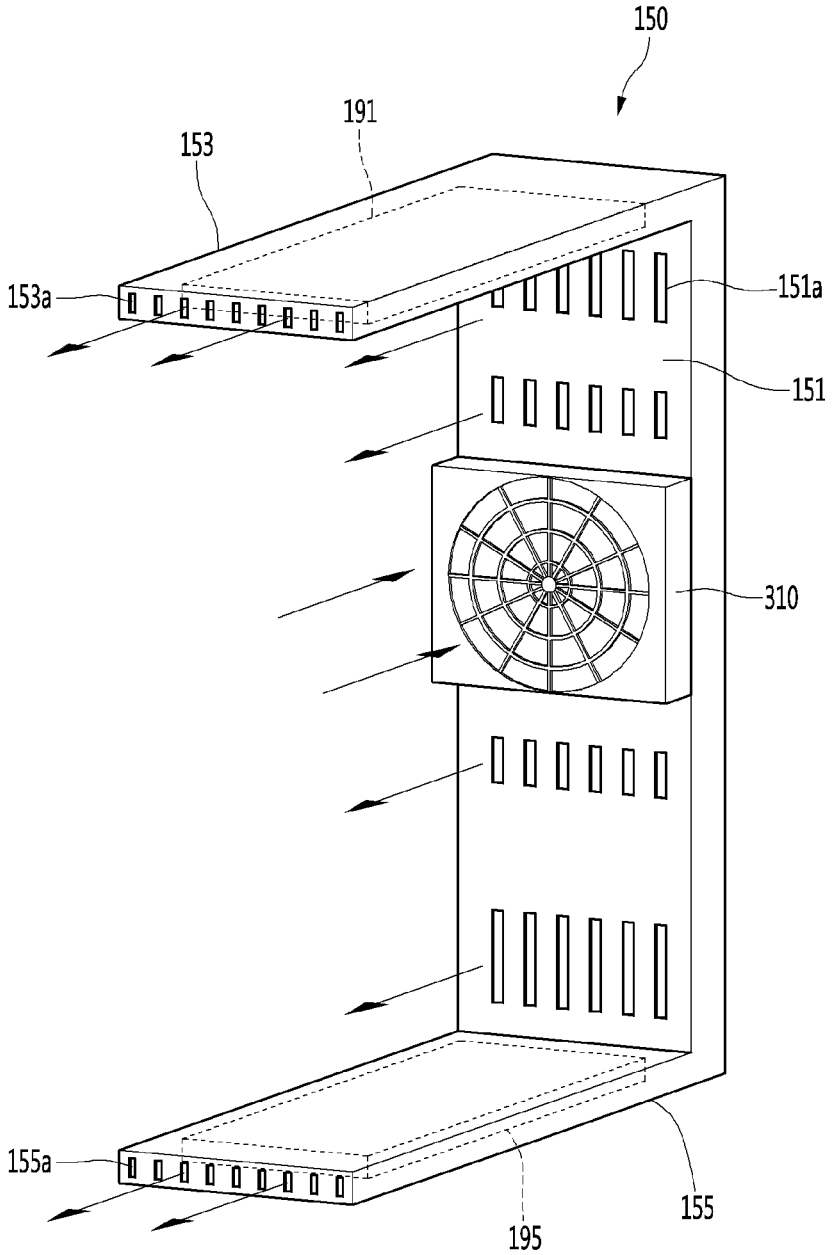
FIG. 6 is a perspective view illustrating a configuration of a supply duct according to the first embodiment of the present invention.
Figure 7:
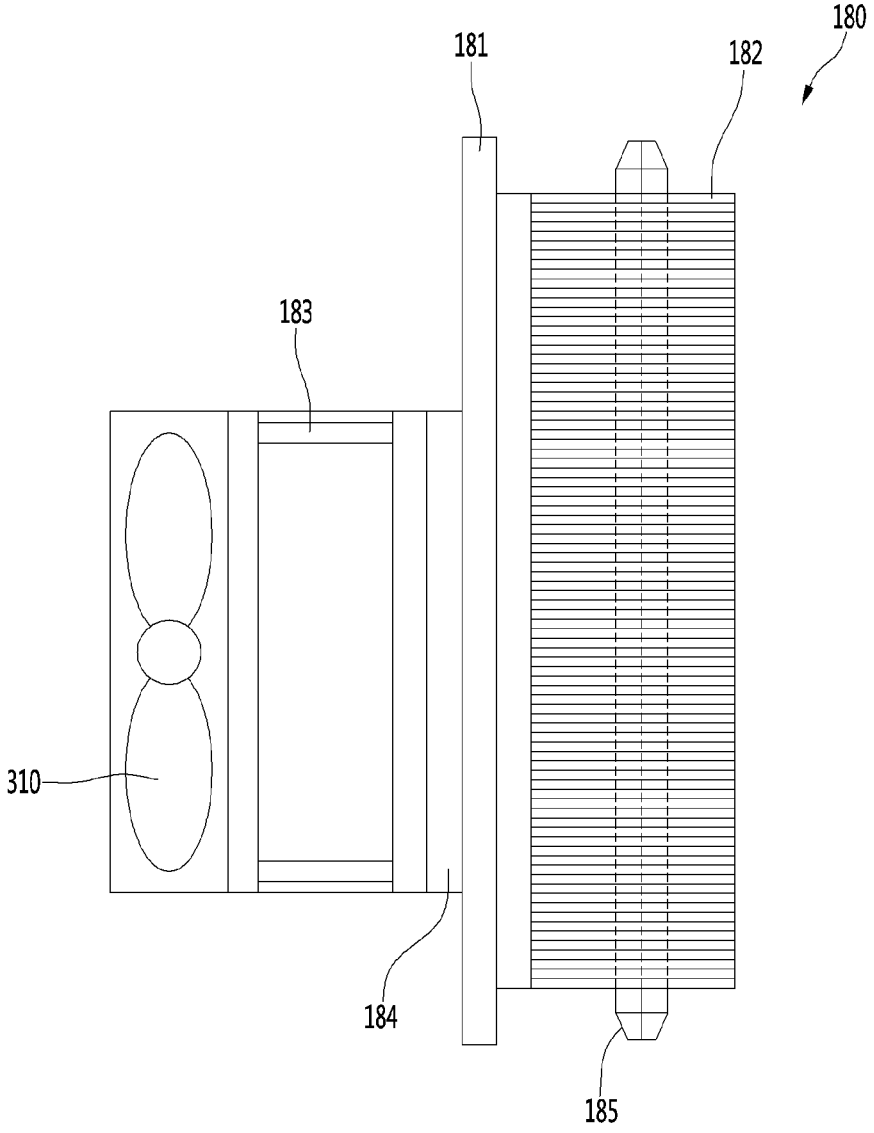
FIG. 7 is a view illustrating a configuration of a thermoelectric device module according to an embodiment of the present invention.

FIG. 4 is a perspective view illustrating a main body configuration of the refrigerator according to the first embodiment of the present invention, FIG. 5 is a view illustrating an internal configuration of the main body of the refrigerator according to the first embodiment of the present invention, FIG. 6 is a perspective view illustrating a configuration of a supply duct according to the first embodiment of the present invention, and FIG. 7 is a view illustrating a configuration of a thermoelectric device module according to an embodiment of the present invention.

Referring to FIGS. 4 to 7, the refrigerator 10 according to the first embodiment of the present invention includes the cabinet 100 forming an outer appearance and a storage chamber 106 for storing food, and a door 120 for shielding the storage chamber 106. For example, the cabinet 100 is configured to have a rectangular parallelepiped shape having an opened front portion, and the door 120 may have a rectangular panel shape.

The door 120 may be provided to be rotatable about the cabinet 100. For example, one side portion of the door 120 may be hinged to the cabinet 100 and the other side portion thereof may be rotated forward about the one side portion of the door 120. The one side portion may be a right side portion, and the other side portion may be a left side portion. A handle 125 operated by a user may be provided on a front surface of the door 120.

The cabinet 100 includes an outer case 101 and an inner case 103 disposed inside the outer case 101 and forming a wall of a storage chamber 106. The outer case 101 may be positioned adjacent to the wall W of the furniture F and may be configured to surround the outer side of the inner case 103.

The cabinet 100 includes a cabinet insulation material 105 disposed between the outer case 101 and the inner case 103 to insulate the storage chamber 106 from the outside of the refrigerator 10. For example, the cabinet insulation material 105 may be formed of polyurethane foam.

The refrigerator 10 further includes a thermoelectric device module 180 disposed inside the cabinet 100 to generate cool air. For example, the thermoelectric device module 180 may be installed on a rear wall of the storage chamber 106. Since the refrigerator 10 is not provided with a component for driving a freezing cycle, that is, as an example, a high noise generation source such as a compressor, there is an effect that the noise generated during driving the refrigerator 10 may be reduced.

The thermoelectric device module 180 is installed on the rear wall of the storage chamber 106 to cool the storage chamber 106. The thermoelectric device module 180 includes a thermoelectric device, and the thermoelectric device refers to a device that implements cooling and heating using a Peltier effect. When the heat absorbing side of the thermoelectric device is disposed so as to face the storage chamber 106 and the heat generating side of the thermoelectric device is disposed so as to face the outside of the refrigerator 10, the storage chamber 106 may be cooled through the operation of the thermoelectric device.

The thermoelectric device module 180 includes a module main body 181 which is coupled with the thermoelectric devices and may have a rectangular plate shape, an endothermic heat sink 183 which is provided at one side of the module main body 181 and performs heat exchange with cool air of the storage chamber 106, and an exothermic heat sink 182 which is provided at an other side of the module body 181 and performs heat exchange with the outdoor air.

One side of the module main body 181 may mean a direction facing the storage chamber 106 with respect to the thermoelectric device module 180 and the other side thereof may mean a direction facing the outside of the refrigerator 10.

The endothermic heat sink 183 is disposed so as to be in contact with a heat absorbing portion of the thermoelectric device, and the exothermal heat sink 182 is disposed so as to be in contact with a heat dissipating portion of the thermoelectric device. The heat absorbing portion and the heat dissipating portion of the thermoelectric device may have a shape capable of surface contact and may form surfaces opposite to each other.

In the thermoelectric device module 180, heat dissipation has to be performed rapidly in the heat dissipating portion of the thermoelectric device, so that sufficient heat absorption may be achieved in the heat absorbing portion of the thermoelectric device. Therefore, a heat exchange area of the exothermal heat sink 182 may be larger than the heat exchange area of the endothermic heat sink 183.

The endothermic heat sink 182 and the exothermal heat sink 183 may respectively include a base contacting the thermoelectric device and a heat transfer fin coupled to the base.

In addition, a heat pipe 185 may be further included in the endothermic heat sink 182 for rapid heat dissipation of the endothermic heat sink 182. The heat pipe 185 may be configured to receive a heat transfer fluid therein, one end of the heat pipe 185 may pass through the base, and an other end thereof may pass through the heat transfer fin.

The thermoelectric device module 180 further includes a module insulation material 184 installed between the endothermic heat sink 183 and the endothermic heat sink 182. For example, the module insulation material 184 may be disposed to surround an edge rim of the thermoelectric device.

A cool air circulation fan 310 which forces cool air circulation in the storage chamber 106 may be installed on a front side of the thermoelectric device module 180, that is, on the side of the thermoelectric device module 180 facing the storage chamber 106. The cool air circulation fan 310 may be positioned in front of the endothermic heat sink 183. For example, the cool air circulation fan 310 may include a centrifugal fan which sucks cool air in an axial direction and discharges the cool air in a radial direction.

The refrigerator 10 further includes a supply duct 150 for guiding flow of cool air generated by the cool air circulation fan 310. The supply duct 150 may be coupled to the inner case 103 to supply cool air towards the storage chamber 106. In detail, cool air existing in the storage chamber 106 flows into the supply duct 150, and the supply duct 150 may perform a function in which cool air heat-exchanged with the endothermic heat sink 183 is discharged to the storage chamber 106 again.

The supply duct 150 may be disposed on the rear wall, an upper wall, and a lower wall of the storage chamber 106 to discharge the cool air into the storage chamber 106. In one example, the supply duct 150 may be disposed by being bent at least twice to have a "a" shape. The bent angle of the supply duct 150 may be 90 degrees.

The endothermic heat sink 183 of the thermoelectric module 180 may be disposed inside the supply duct 150. Therefore, the cool air introduced into the supply duct 150 may be cooled while exchanging heat with the endothermic heat sink 183. The cooled cool air may be discharged from the supply duct 150 and may be introduced back into the storage chamber 106.

A cold storage agent 190 may be installed in the supply duct 150. The cold storage agent 190 stores the coolness of the cool air by being cooled by the cool air flowing through the supply duct 150. When the refrigerator 10 is carried and the cool air circulation fan 310 is stopped, for example, the stored coolness of the cool air is discharged, and the cold storage agent 190 performs a function of keeping the cooling state of the storage chamber 106. The cold storage agent 190 may include a phase change material (PCM) which discharges the coolness of the cool air through a phase change process. For example, the cold storage agent 190 may include water or ice, clathrate, or eutectic salt.

The refrigerator 10 further includes a heat dissipating duct 400 for guiding a flow of an outdoor air. The outdoor air outside the refrigerator 10 flows into the heat dissipating duct 400 and the outdoor air heat exchanged with the exothermic heat sink 182 is discharged to the outside of the refrigerator 10 again. The exothermic heat sink 182 may be disposed inside the heat dissipating duct 400.

The heat dissipating duct 400 is disposed to be embedded in the cabinet insulation material 105 and may be disposed at a rear portion, an upper portion, and a lower portion of the cabinet 100. For example, the heat dissipating duct 400 may be disposed by being bent at least twice so as to have a "⊏" shape. The bent angle of the heat discharging duct 400 may be 90 degrees. The heat dissipating duct 400 may be disposed along an outer side of the supply duct 150.

The heat dissipating duct 400 includes a first inlet and outlet portion 441 and a second inlet and outlet portion 445 for introducing or discharging outdoor air. The first inlet and outlet portion 441 may be disposed at an upper-end portion of the heat dissipating duct 400 and the second inlet and outlet portion 445 may be disposed at a lower end portion of the heat dissipating duct 400.

The refrigerator 100 further includes heat dissipating fans 320 and 330 disposed on an internal flow path of the heat dissipating duct 400 for forcing a flow of the outdoor air. The heat dissipating fans 320 and 330 include a first heat dissipating fan 320 disposed at an upper portion of the heat dissipating duct 400 and a second heat dissipating fan 330 disposed at a lower portion of the heat dissipating duct 400. The first heat dissipating fan 320 may be disposed at an upper bent portion of the heat dissipating duct 400 and the second heat dissipating fan 330 may be disposed at a lower bent portion of the heat dissipating duct 400.

According to a rotation direction of the first and second heat dissipating fans 320 and 330, the flow direction of the outdoor air in the first and second inlet and outlet portions 441 and 445 may be different. In this regard, it will be described later with reference to FIG. 9.

In front of the cabinet 100, inlet and outlet grilles 131 and 135 for flowing outdoor air into the heat dissipating duct 400 and discharging the outdoor air heat-exchanged in the heat dissipating duct 400 to the outside of the refrigerator are included. The inlet and outlet grilles 131 and 135 include a first inlet and outlet grill 131 disposed at an upper portion of the cabinet 100 and a second inlet and outlet grill 135 disposed at a lower portion of the cabinet 100.

The first inlet and outlet grill 131 is positioned above the door 120 and is positioned in front of the first inlet and outlet portion 441, and thus communicates with the first inlet and outlet portion 441. The second inlet and outlet grill 135 is positioned below the door 120 and is positioned in front of the second inlet and outlet portion 445, and thus communicates with the second inlet and outlet portion 445.

The supply duct 150 will now be described in more detail using FIG. 6.

The supply duct 150 may be installed in the rear wall, the top wall, and the bottom wall of the storage chamber 106.

In detail, the supply duct 150 includes a first supply duct 151 installed in the inner case 103 forming a rear wall of the storage chamber 106. The first supply duct 151 may extend vertically from the rear wall of the storage chamber 16. The cool air circulation fan 310 may be installed at a central portion of the first supply duct 151.

The endothermic heat sink 183 of the thermoelectric device module 180 may be positioned in the first supply duct 151. Therefore, the cool air flowing through the first supply duct 151 may exchange heat with the endothermic heat sink 183.

The cool air existing in the storage chamber 106 may be sucked into the cool air circulation fan 310 by driving the cool air circulation fan 310 and may be cooled while passing the endothermic heat sink 183 positioned at the rear of the cool air circulation fan 310. The cooled cool air may flow upward and downward the first supply duct 151 towards upper and lower portions of the first supply duct 151.

In the supply duct 150, a plurality of cool air discharge holes 151*a*, 153*a*, and 155*a* may be formed. The first supply duct 151 is provided with a first discharge hole 151*a* for discharging cool air into the storage chamber 106. The first discharge hole 151*a* may be formed on a front surface of the first supply duct 151 and may be exposed to the storage chamber 106. The cool air discharged from the first discharge hole 151*a* may flow towards a front portion of the storage chamber 106.

The supply duct 150 includes a second supply duct 153 installed in the inner case 103 forming the upper wall of the storage chamber 106. The second supply duct 153 may extend forward from the upper portion of the first supply duct 151. The cool air which has flowed from the cool air circulation fan 310 to the upper portion of the first supply duct 151 may flow forward through the second supply duct 153.

A second discharge hole 153*a* for discharging the cool air of the second supply duct 153 to the front portion of the storage chamber 106 may be formed in a front portion of the second supply duct 153. For example, the second discharge hole 153*a* may be formed at the front end portion of the second supply duct 153 and may be positioned adjacent to the door 120. Accordingly, the cool air discharged from the second discharge hole 153*a* may be discharged to a side of the door 120 and may be supplied to the front portion of the storage chamber 106 along an inner surface of the door 120.

The supply duct 150 further includes a third supply duct 155 installed in the inner case 103 forming the lower wall of the storage chamber 106. The third supply duct 155 may extend forward from the lower portion of the first supply duct 151. The cool air which has flowed from the cool air circulation fan 310 to the lower portion of the first supply duct 151 may flow forward through the third supply duct 155.

A third discharge hole 155*a* for discharging the cool air of the third supply duct 155 to the front portion of the storage chamber 106 is formed in a front portion of the third supply duct 155. For example, the third discharge hole 155*a* may be formed at a front end portion of the third supply duct 155 and may be positioned adjacent to the door 120. Therefore, the cool air discharged from the third discharge hole 155*a* may be discharged to the side of the door 120 and may be supplied to the front portion of the storage chamber 106 along the inner surface of the door 120.

The refrigerator 10 further includes a cold storage agent 190 installed inside the supply duct 150. The cold storage agent 190 may have a thin flat plate shape and have a predetermined length.

The cold storage agent 190 may be cooled by cool air flowing through the supply duct 150 to store the coolness of the cool air. The coolness of the cool air stored in the cold storage agent 190 may cool the storage chamber 106 by way of conduction or convection. As described above, the cold storage agent 190 may include a phase change material.

The cold storage agent 190 may be installed in the second supply duct 153 or the third supply duct 155. The second supply duct 153 or the third supply duct 155 may be configured to extend forward from the first supply duct 151 so that the cold storage agent 190 may be easily installed in the second and third ducts 153 and 155.

The cold storage agent 190 may include a first cold storage agent 191 installed in the second supply duct 153. The cool air flowing through the second supply duct 153 may cool the first cold storage agent 191 and the cooled first cold storage agent 191 may discharge the coolness of the cool air during the phase change process. For example, when the refrigerator 10 is carried and the cool air circulation fan 310 is not driven, the coolness of the cool air stored in the first cold storage agent 191 may be supplied to the storage chamber 106.

The cold storage agent 190 may include a second cold storage agent 195 installed inside the third supply duct 155. The cool air flowing through the second supply duct 153 may cool the second cold storage agent 195 and the cooled second cold storage agent 195 may cool the cool air during the phase change process. For example, when the refrigerator 10 is carried and the cool air circulation fan 310 is not driven, the coolness of the cool air stored in the second cold storage agent 195 may be supplied to the storage chamber 106.

Figure 8:
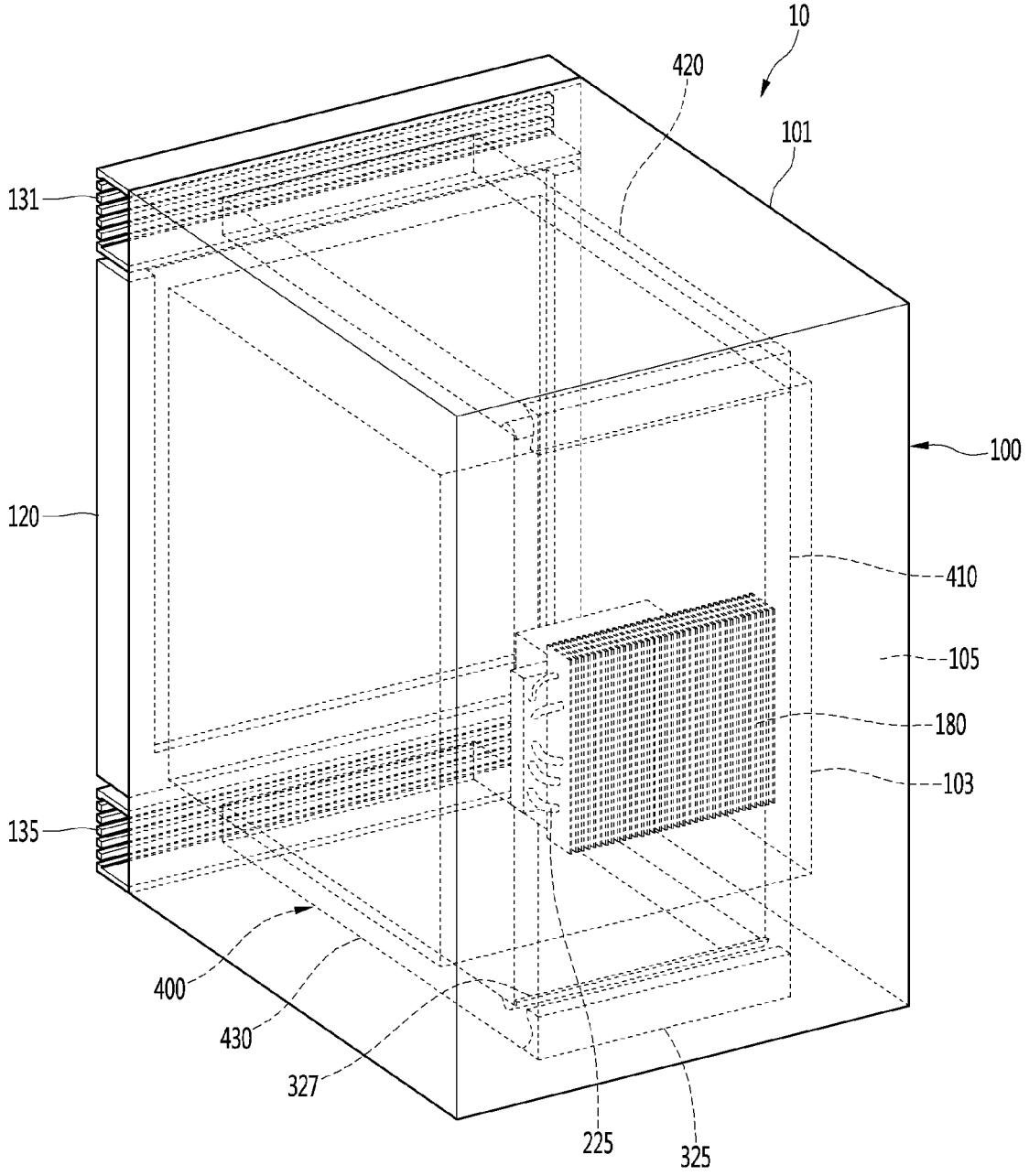
FIG. 8 is a view illustrating a state where a heat dissipating duct according to the first embodiment of the present invention is disposed inside a cabinet.
Figure 9:
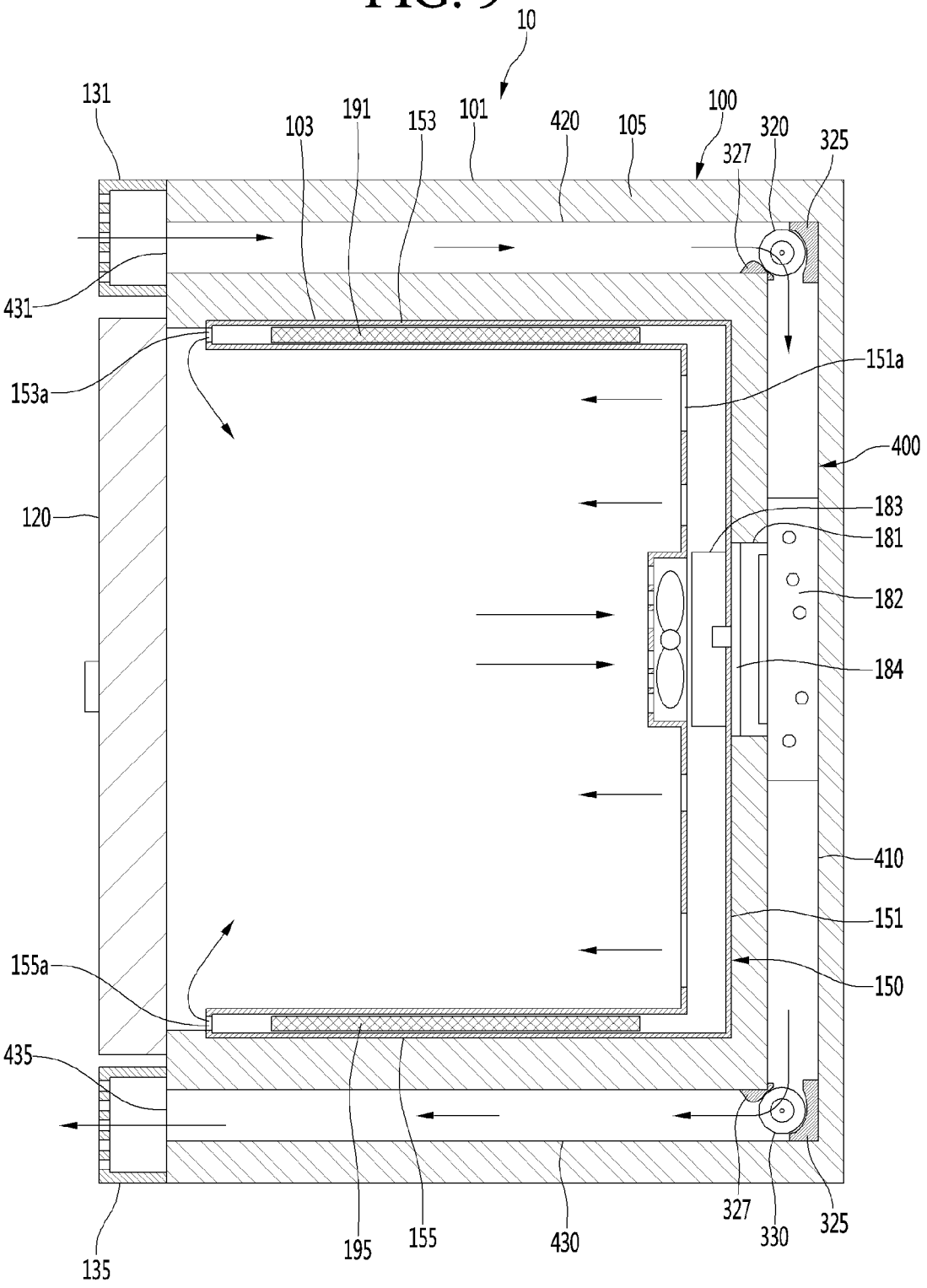
FIG. 9 is a view illustrating a flow of cool air and outdoor air in a structure of the refrigerator according to the first embodiment of the present invention.

FIG. 8 is a view illustrating a state where the heat dissipating duct according to the first embodiment of the present invention is disposed inside the cabinet, and FIG. 9 is a view illustrating a state of relating to a flow of cool air and outdoor air in a structure of the refrigerator according to the first embodiment of the present invention.

Referring to FIGS. 8 and 9, the refrigerator 10 according to the first embodiment of the present invention further includes the heat dissipating duct 400 which is embedded in the cabinet insulation material 105. The heat dissipating duct 400 may be understood as a duct communicating with the outdoor air.

The heat dissipating duct 400 includes a first heat dissipating duct 410 installed on the cabinet insulation material 105 provided at the rear portion of the cabinet 100, a second heat dissipating duct 420 extending forward from an upper portion of the first heat dissipating duct 410, the second heat dissipating duct 420 communicating with the first inlet and outlet grill 131, and a third heat dissipating duct 430 extending forward from a lower portion of the first heat dissipating duct 410 and communicating with the second inlet and outlet grill 135.

The exothermic heat sink 182 of the thermoelectric device module 200 may be positioned in the first heat dissipating duct 410. Therefore, the outdoor air flowing through the first heat dissipating duct 410 may exchange heat with the exothermic heat sink 182.

A first inlet and outlet portion 431 which is disposed adjacent to the first inlet and outlet grill 131 and introduces outdoor air introduced through the first inlet and outlet grill 131 or guides the air of the second heat dissipating duct 420 to the first inlet and outlet grill 131 is provided in the front end portion of the second heat dissipating duct 420.

A second inlet and outlet portion 435 which is disposed adjacent to the second inlet and outlet grill 135 and introduces outdoor air introduced through the second inlet and outlet grill 135 or guides the air of the third heat dissipating duct 430 to the second inlet and outlet grill 135 is provided in the front end portion of the third heat dissipating duct 430.

The first and second heat dissipating fans 320 and 330 may be installed in the heat dissipating duct 400 to force circulation of the outdoor air. The first heat dissipating fan 320 may be installed on the upper portion of the first heat dissipating duct 410, that is, a portion where the first heat dissipating duct 410 and the second heat dissipating duct 420 meet. The second heat dissipating fan 330 may be installed at the lower portion of the first heat dissipating duct 410, that is, a portion where the first heat dissipating duct 410 and the third heat dissipating duct 430 meet.

The first and second heat dissipating fans 320 and 330 may include a cross-flow fan. The cross-flow fan is a fan which sucks air in a circumferential direction and discharges air in the circumferential direction and the air flowing from the first heat dissipating duct 410 to the second heat dissipating duct 420 or the third heat dissipating duct 430 may be guided.

Flow guide portions 325 and 327 that guide for a stable flow of air may be installed around the first and second heat dissipating fans 320 and 330, respectively. The flow guide portions 325 and 327 include a rear guide 325 provided at one side of the heat dissipating fans 320 and 330 and a stabilizer 327 provided at an other side thereof.

The rear guide 325 is disposed adjacent to an outer circumferential surface of the heat dissipating fans 320 and 330 to guide the air sucked by the heat dissipating fans 320 and 330 to be discharged in the circumferential direction. The stabilizer 327 may prevent the air discharged from the heat dissipating fans 320 and 330 from being sucked back to the suction side of the heat dissipating fans 320 and 330.

The flow of cool air and outdoor air in the refrigerator 10 will now be described.

According to the rotational direction of the first heat dissipating fan 320 and the second heat dissipating fan 330, the directions of inflow and outflow of the outdoor air may be different from each other.

For example, referring to FIG. 9, when the first and second heat dissipating fans 320 and 330 rotate clockwise, the outdoor air flows into the second heat dissipating duct 420 through the first inlet and outlet grill 131. The outdoor air is heat-exchanged with the exothermic heat sink 182 disposed in the first heat dissipating duct 410, absorbs heat, and then is discharged from the third heat dissipating duct 430 through the second inlet and outlet grill 135.

However, unlike this, when the first and second heat dissipating fans 320 and 330 rotate in a counterclockwise direction, the outdoor air flows into the third heat dissipating duct 430 through the second inlet and outlet grill 135. The outdoor air is heat-exchanged with the exothermic heat sink 182 disposed in the first heat dissipating duct 410, absorbs heat, and then is discharged from the second heat dissipating duct 420 through the first inlet and outlet grill 131.

Meanwhile, when the cool air circulation fan 310 is driven, the cool air existing in the storage chamber 106 flows into the cool air circulation fan 310 and may cool while passing the endothermic heat sink 183 positioned at the rear of the cool air circulation fan 310. Some of the cool air in the cooled cool air may be discharged to the storage chamber 106 through the first discharge hole 151*a* of the first supply duct 151.

Some of the cool air may flow to the upper portion of the first supply duct 151, flow forward through the second supply duct 153, and is discharged to the storage chamber 106 through the second discharge hole 153*a*. The remaining cool air may flow to the lower portion of the first supply duct 151, flow forward through the third supply duct 155, and be discharged to the storage chamber 106 through the third discharge hole 155*a*.

Figure 10:
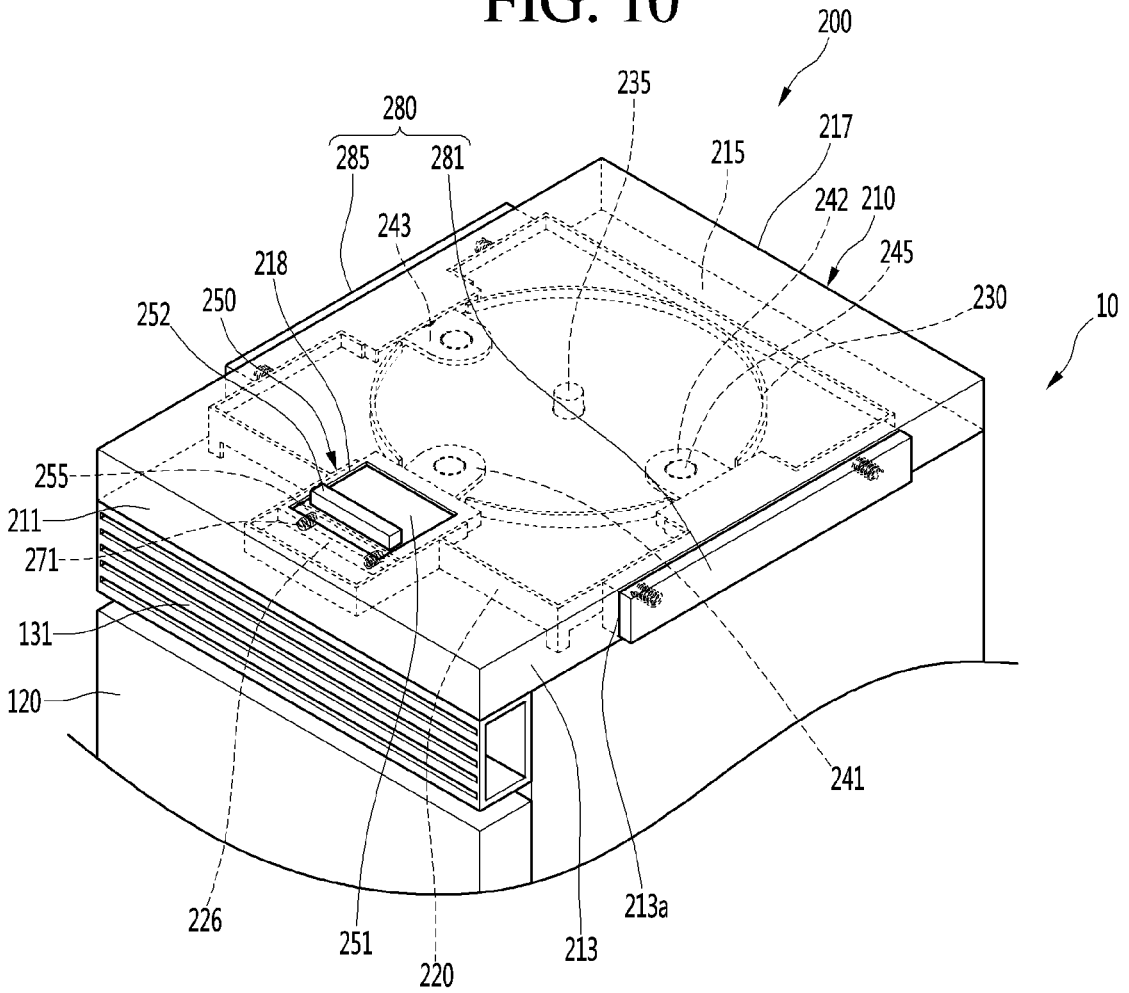
FIG. 10 is a view illustrating an upper configuration of the refrigerator according to the first embodiment of the present invention.
Figure 11:
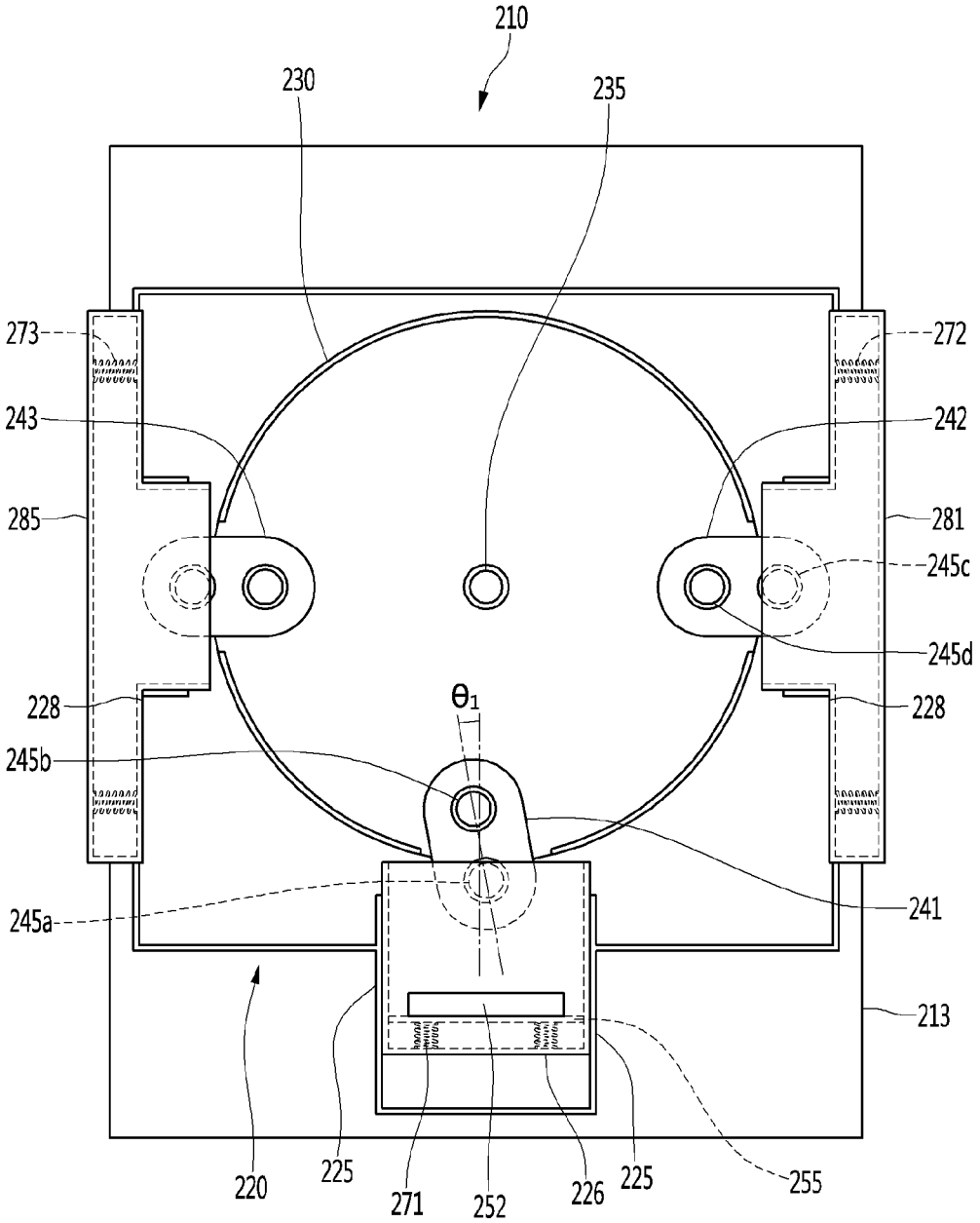
FIG. 11 is a view illustrating a configuration of a contact mechanism according to the first embodiment of the present invention.

FIG. 10 is a view illustrating an upper configuration of the refrigerator according to the first embodiment of the present invention, and FIG. 11 is a view illustrating a configuration of a contact mechanism according to the first embodiment of the present invention.

Referring to FIGS. 10 and 11, the refrigerator 10 according to the first embodiment of the present invention includes a contact mechanism 200 disposed on one side of the refrigerator main body. The contact mechanism 200 may be understood as a mechanism for bringing the refrigerator 10 into contact with an object to be installed in by a user's operation. At least a portion of the refrigerator 10 may be brought into contact with one surface of the object to be installed in. For example, the object to be installed in includes the furniture F illustrated in FIG. 1, and a wall W of the furniture F may be a surface where at least a portion of the refrigerator 10 is in contact.

The contact mechanism 200 includes a contact member 280 which makes contact with the wall W of the furniture F. The contact member 280 is provided on a side surface of the contact mechanism 200 and may be movably provided according to an operation of a lever 250.

In detail, the contact mechanism 200 includes a housing 210. The housing 210 may be provided with a space in which a power transmitting element for transmitting a force generated in the lever 250 to the contact member 280 is installed. For example, the housing 210 may have an outer appearance shape of a hexahedron.

The housing 210 includes a housing front portion 211 and a housing side portion 213. The housing side portion 213 extends rearward from both sides of the housing front portion 211. The housing 210 further includes a housing upper portion 215 which forms an upper surface of the housing 210 and connects the two housing side portions 213 and a housing rear portion 217 connecting the rear portions of the two housing side portions 213.

The housing upper portion 215 is provided with the lever 250. The lever 250 may protrude upward from the housing upper portion 215 and may be held by the user to move the lever 250 forward or backward.

A cutout portion 218 is formed in the housing upper portion 215 and the lever 250 may extend from the inside of the housing 210 to the outside of the housing 210 through the cutout portion 218. In detail, the lever 250 is provided with a lever main body 251 which is positioned below the cutout portion 218 and is movable, and a handle 252 which protrudes upward from the lever main body 251 and formed to be gripped by the user. For example, the lever 250 may be positioned at a front portion of the housing upper portion 215.

The lever 250 may be provided to be linearly movable. For example, the lever 250 may be moved forward or rearward of the housing 210 or the refrigerator 10. The lever 250 moves from the inside of the cutout portion 218 and when the lever 250 interferes with the cutout portion 218, further movement of the lever 250 may be restricted. Therefore, the cutout portion 218 may function as a stopper of the lever 250.

The housing 210 further includes a disk 230 which rotates according to the linear movement of the lever 250. The disk 230 may be positioned at a substantially central portion of the housing 210 and may have a circular plate shape. For example, when the lever 250 is moved to the rear of the housing 210, the disk 230 rotates in a clockwise direction, and when the lever 250 is moved forward of the housing 210, the disk 230 rotates in a counterclockwise direction.

A central shaft 235 forming a center of rotation of the disk 230 is provided at a central portion of the disk 230.

The contact mechanism 200 further includes a link which is installed inside the housing 210 and transmits power to the disk 230 according to the movement of the lever 250.

The link includes a first link 241 rotatably coupled to the lever 250. The lever 250 and the first link 241 may be pin-coupled. The first link 241 may be rotatably coupled to the disk 230.

In detail, a rear portion of the lever 250 and a front portion of the first link 241 may be coupled by the first pin 245*a*. The first pin 245*a* may extend in the vertical direction and be coupled to the lever 250 and the first link 241. At this time, the front portion of the first link 241 may be inserted into the lever 250 or may be positioned on an upper side or a lower side of the lever 250.

The first link 241 and the disk 230 may be coupled by a second pin 245*b*. The second pin 245*b* may extend in the vertical direction and may be coupled to the lever 250 and the first link 241. At this time, the rear portion of the first link 241 may be positioned above the disk 230. Alternatively, the rear portion of the first link 241 may be positioned below the disk 230.

In short, the lever 250 and the disk 230 are pin-coupled to both side portions of the first link 241 and the first link 241 may move so as to relatively rotate with respect to the lever 250 or the disk 230.

The contact mechanism 200 further includes the contact member 280 disposed on the housing side portion 213 and moves in the lateral direction according to the rotation of the disk 230. The housing side portion 213 may include an insertion portion 213*a* to which the contact member 280 is installed. The contact member 280 may be inserted into the insertion portion 213*a* and moves in the lateral direction.

The contact member 280 includes a first contact member 281 disposed on one side portion of the housing 210 and a second contact member 285 disposed on the other side portion of the housing 210.

The contact member 280 may be linearly moved in a direction away from the housing side portion 213, that is, so as to protrude from the housing side surface 213 when the disk 230 rotates in one direction. At this time, the first and second contact members 281 and 285 may move in directions away from each other, respectively.

When the disk 230 rotates in the other direction, the contact member 280 may move linearly in a direction towards the housing side portion 213, that is, in a direction to be inserted into the housing side portion 213. At this time, the first and second contact members 281 and 285 may move in directions to approach each other, respectively.

The link further includes second and third links 242 and 243 rotatably coupled to the first and second contact members 281 and 285, respectively.

In detail, the second link 242 may be rotatably coupled to the first contact member 281. The second link 242 may also be rotatably coupled to the disk 230. The second link 242 may extend in the lateral direction.

The third link 243 may be rotatably coupled to the second contact member 285. The third link 243 may also be rotatably coupled to the disk 230. The third link 243 may extend in the lateral direction.

The second and third links 242 and 243 may be disposed on either side with respect to the center shaft 235 of the disk 230. In other words, the center line passing through the center shaft 235 in the transverse direction passes through the second and third links 242 and 243.

The second and third links 242 and 243 may be respectively pinned to the contact members 281 and 285 by a third pin 245*c* and respectively pinned to the disk 230 by a fourth pin 245*d*.

The third pin 245*c* may extend in the vertical direction and be coupled to the contact members 281 and 285. At this time, one side portion of the second and third links 241 may be inserted into the contact members 281 and 285.

The fourth pin 245*d* may extend in the vertical direction and be coupled to the disk 230. At this time, the other side portion of the second and third links 242 and 243 may be positioned above the disk 230. Alternatively, the other side portion of the second and third links 242 and 243 may be positioned below the disk 230.

In short, the first and second contact members 281 and 285 and the disk 230 are pin-coupled to respective side portions of the second and third links 242 and 243, and the second and third links 242 and 243 may move so as to relatively rotate with respect to the first and second contact members 281 and the disk 230.

The contact mechanism 200 further includes a frame 220 provided in the housing 210. The frame 220 may be provided outside the disk 230.

The frame 220 includes two lever supports 225 for supporting both sides of the lever 250. The two lever supports 225 are spaced apart from each other, and the lever 250 may move between the two lever supports 225 in the front and rear direction. In other words, the lever supports 225 may function as a "guide rail".

The frame 220 further includes a contact member support 228 for supporting the contact member 280.

The contact mechanism 200 may further include an elastic member which applies an elastic force to the movement of the lever 250 or the contact member 280.

The elastic member includes a first elastic member 271 for providing a restoring force to the lever 250. For example, the first elastic member 271 may include a tension spring.

The first elastic member 271 may be disposed between a spring coupling portion 255 and a spring support jaw 226. The spring coupling portion 255 may extend downward from the lever main body 251 and one end portion of the first elastic member 271 may be coupled to the spring coupling portion 255.

The spring support jaw 226 is provided between the two lever supports 225 as one configuration of the frame 220 and may extend in the lateral direction. The other end portion of the first elastic member 271 may be coupled to the spring support jaw 226.

When the lever 250 moves backward, the spring coupling portion 255 also moves rearward, and the first elastic member 271 may be tensioned in a state of being supported by the spring support jaw 226.

The elastic member further includes a second elastic member 272 for providing a restoring force to the first contact member 281. For example, the second elastic member 272 may include a tension spring.

The second elastic member 272 may be disposed between the first contact member 281 and the contact member support 228. One end portion of the second elastic member 272 may be coupled to an inside surface of a side portion of the first contact member 281.

The contact member supports 228 may extend in the front and rear direction as one configuration of the frame 220 and may be provided on both sides of the frame 220, respectively. The other end portion of the second elastic member 272 may be coupled to the contact member support 228.

A plurality of the second elastic members 272 may be provided and disposed on both sides of the first contact member 281.

When the lever 250 is moved backward, the disk 230 rotates and the first contact member 281 may move in a direction protruding from the housing side portion 213 in accordance with the rotation of the disk 230. At this time, the second elastic member 272 may be tensioned in a state of being supported by the contact member support 228.

The elastic member further includes a third elastic member 273 for providing a restoring force to the second contact member 285. For example, the third elastic member 273 may include a tension spring.

The third elastic member 273 may be disposed between the second contact member 285 and the contact member support 228. One end portion of the third elastic member 273 is coupled to the inside surface of the side portion of the second contact member 285 and the other end portion of the third elastic member 273 is coupled to the contact member support 228. The second elastic member 272 may be coupled to one 228 of both side contact member supports and the third elastic member 273 may be coupled to the other thereof.

A plurality of the third elastic members 273 may be provided and disposed on both sides of the second contact member 285.

When the lever 250 is moved backward, the disk 230 rotates and the second contact member 285 may move in a direction protruding from the housing side portion 213 in accordance with the rotation of the disk 230. At this time, the third elastic member 273 may be tensioned in a state of being supported by the contact member support 228.

Meanwhile, the first link 241 may extend obliquely rearward from the portion coupled to the lever 250 by a predetermined angle θ1. Specifically, as illustrated in FIG. 11, a line passing through the center of the first link 241 may be inclined at a predetermined angle θ1 with respect to an imaginary line extending in the front and rear direction. In this case, a line passing through the center of the first link 241 may be understood as a line passing through the center of the first and second pins 245*a* and 245*b*. For example, the second pin 245*b* may be positioned on the left side of the first pin 245*a*.

According to this configuration, when the lever 250 is moved backward, the first link 241 may be easily rotated. In accordance with the rotation of the first link 241, the disk 230 receives the rotational force through the second pin 245*b* and rotates in a predetermined direction.

Figure 12A:
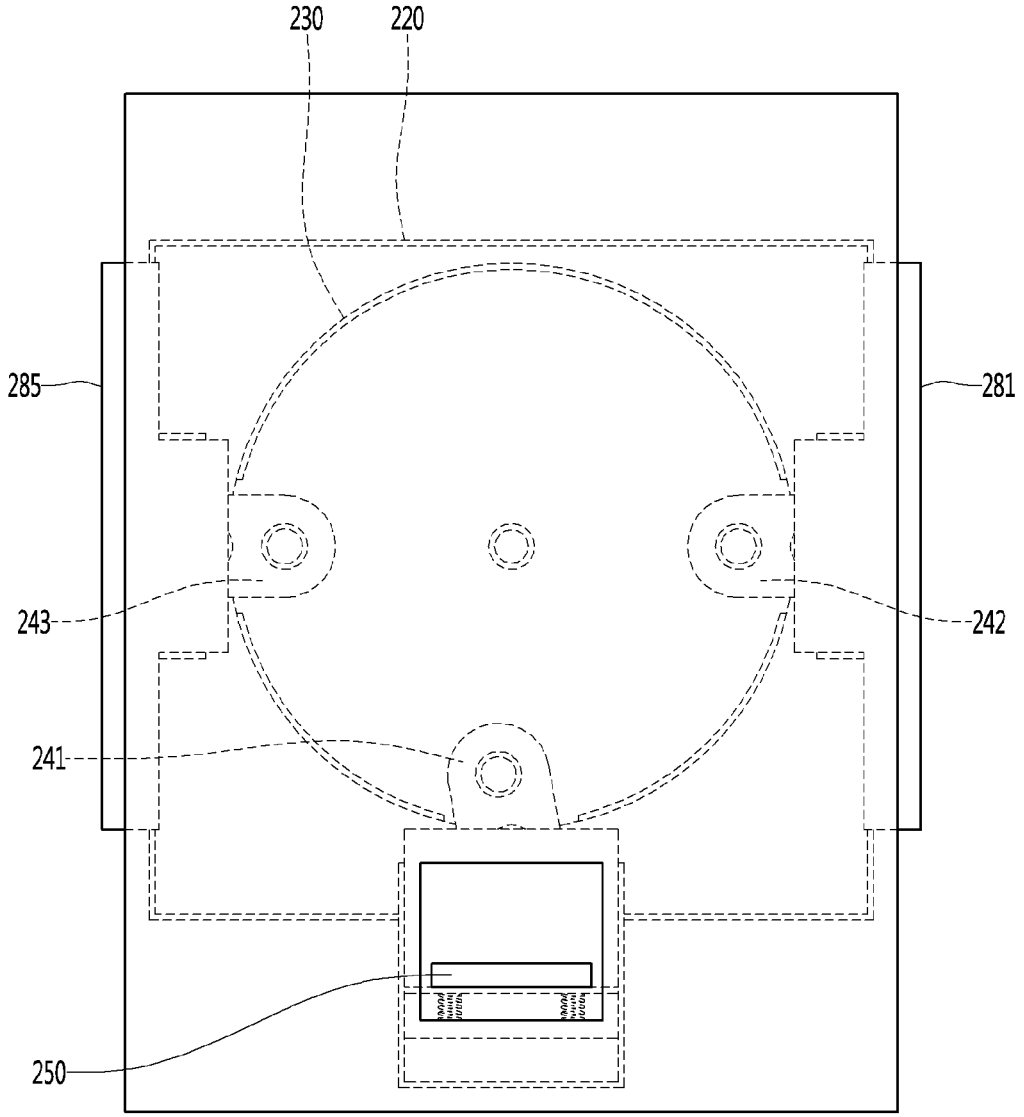
FIGS. 12*a* to 12*c* are views illustrating an operation of the contact mechanism according to the first embodiment of the present invention.
Figure 12B:
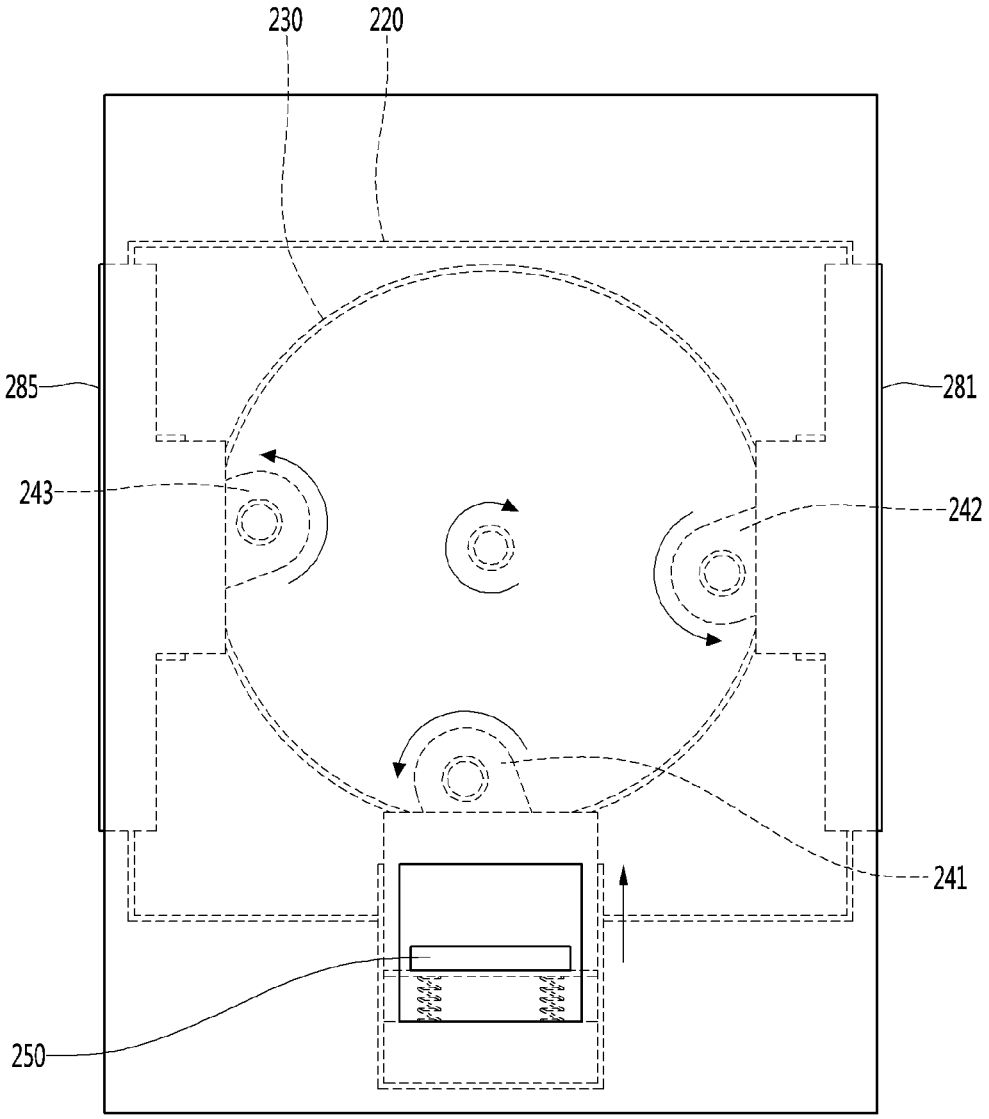
Figure 12C:
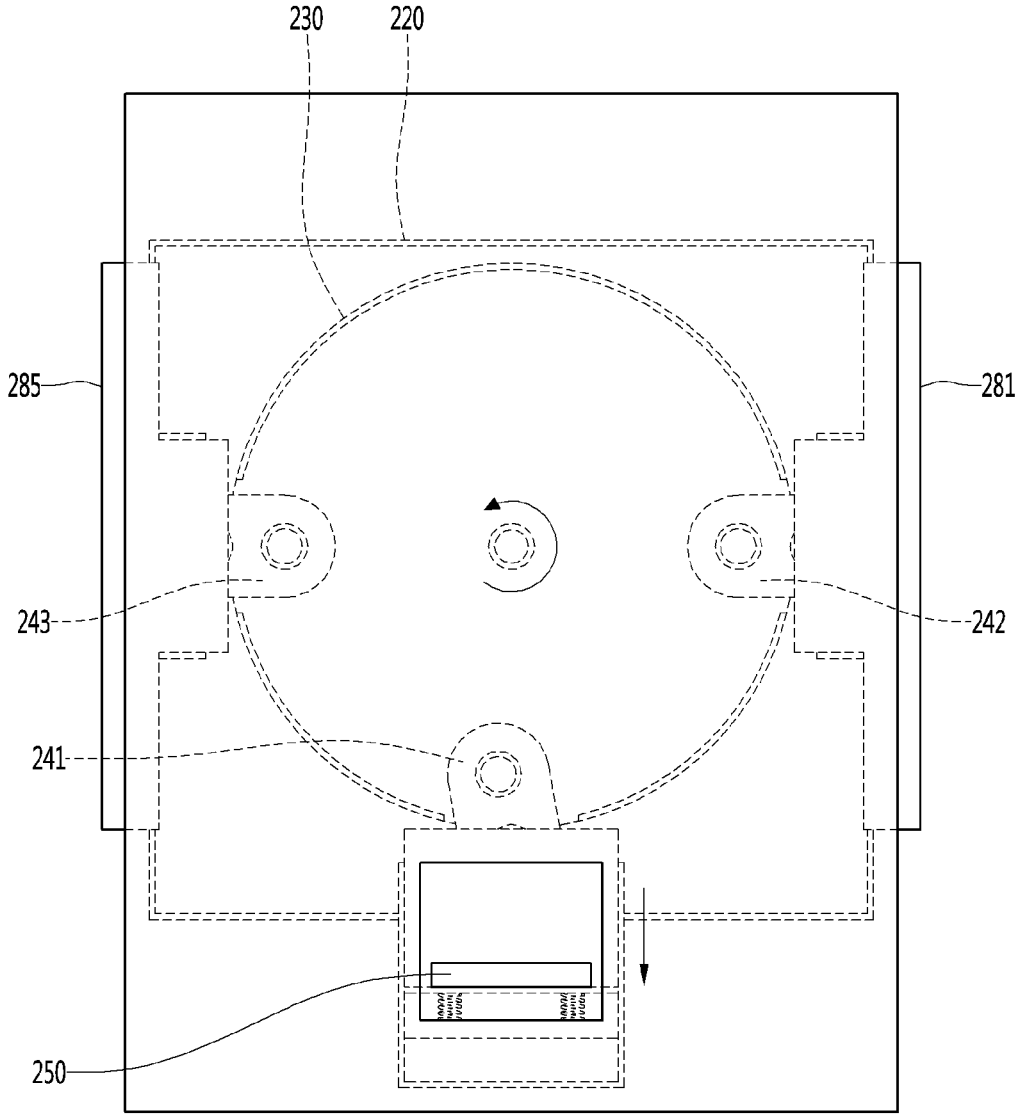
Figure 13:
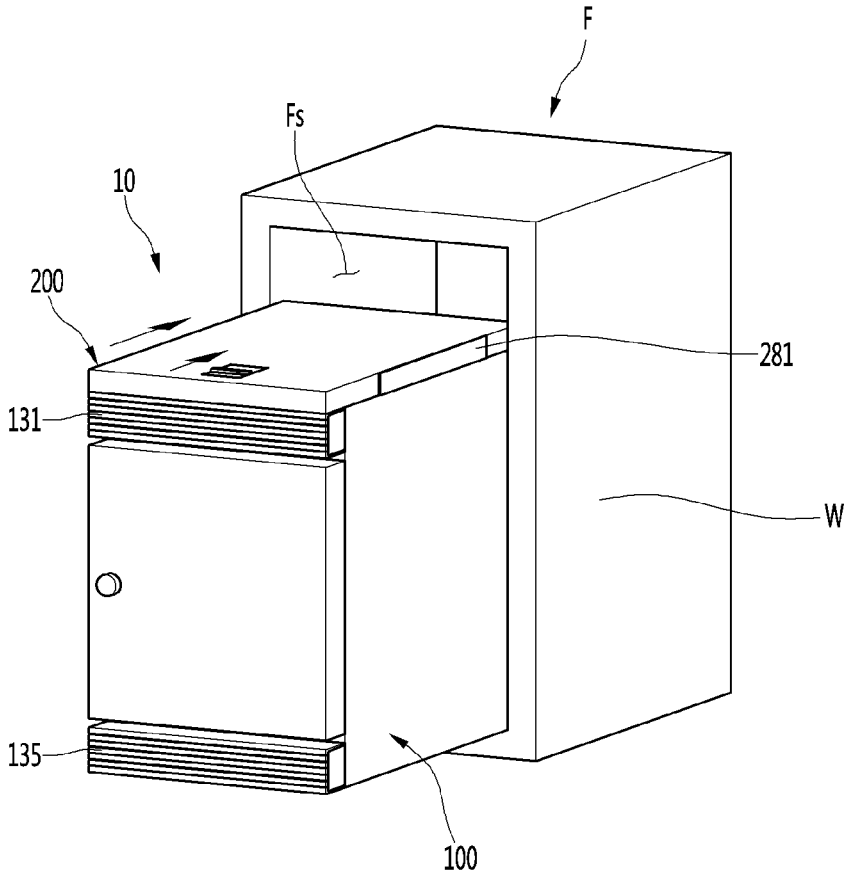
FIG. 13 is a view illustrating a state where the refrigerator according to the first embodiment of the present invention is housed in a storage space of furniture.
Figure 14A:
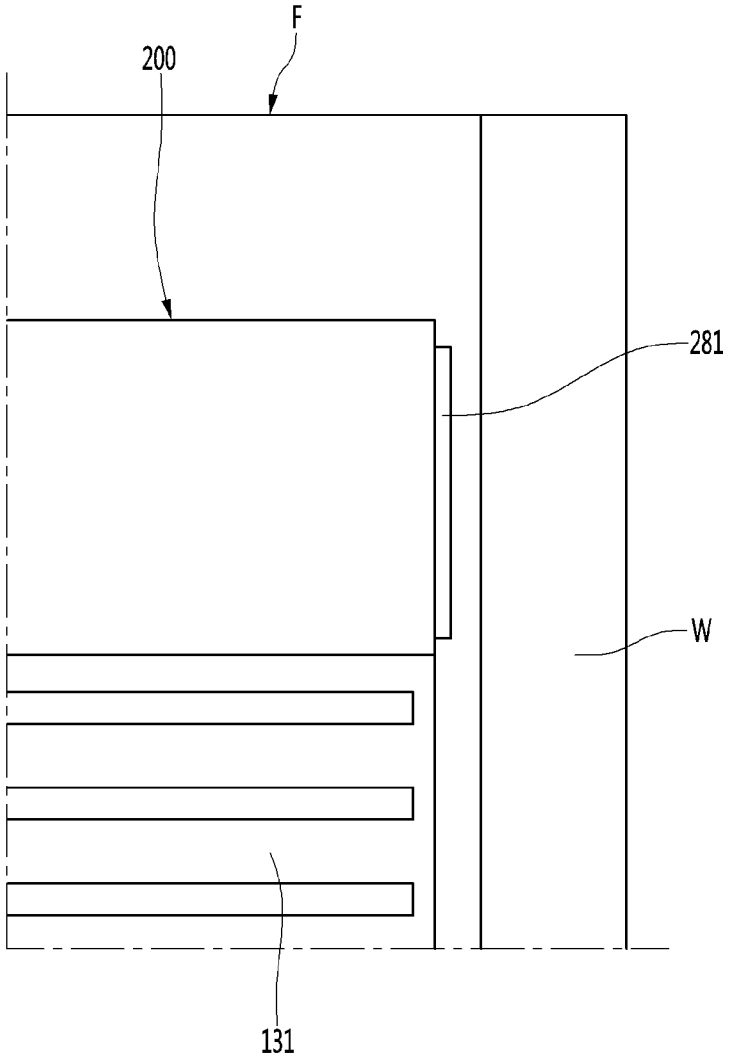
FIGS. 14*a* and 14*b* are views illustrating an operation of the contact member after the refrigerator according to the first embodiment of the present invention is housed in the furniture.
Figure 14B:
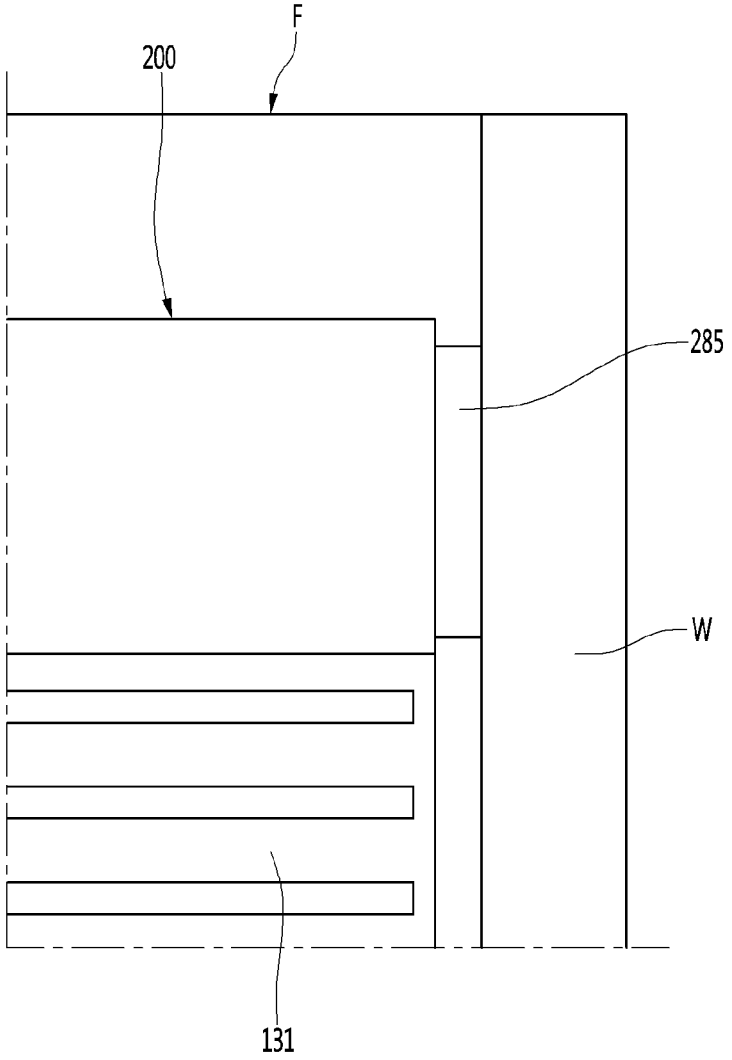

FIGS. 12*a* to 12*c* are views illustrating an operation of the contact mechanism according to the first embodiment of the present invention, FIG. 13 is a view illustrating a state where the refrigerator according to the first embodiment of the present invention is housed in the storage space of the furniture, and FIGS. 14*a* and 14*b* are views illustrating an operation of the contact member after the refrigerator according to the first embodiment of the present invention is housed in the furniture.

First, as illustrated in FIG. 12*a*, when the lever 250 of the refrigerator 10 is not operated, the lever 250 is positioned at a relatively forward position in the cutout portion 218, the disk 230 is in a non-rotated "reference position", and the first and second contact members 281 and 285 are in a position protruding from the housing side surface 213.

Next, as illustrated in FIG. 13, when the refrigerator 10 is put into the storage space Fs of the furniture F, the user may move the lever 250 rearward. Then, as illustrated in FIG. 12*b*, force is asserted on the first link 241 through the first pin 245*a* and rotates in a counterclockwise direction with respect to the second pin 245*a*.

In this process, the disk 230 rotates in the clockwise direction to be in "the rotated position". The second and third links 242 and 243 rotate in the counterclockwise direction with respect to the fourth pin 245*d*. According to the rotation of the second and third links 242 and 243, the first and second contact members 281 and 285 may be pulled through the third pin 245*d* and move in a direction in which they approach towards each other. In other words, the first and second contact members 281 and 285 may move toward the central shaft 235 of the disk 230 and may enter the inside of the housing 210. As a result, the protruding length of the first and second contact members 281 and 285 from the housing side surface 213 is reduced. The protruding length of the first and second contact members 281 and 285 may be flush with the housing side surface 213.

FIG. 14*a* illustrates a state where the first and second contact members 281 and 285 are drawn into the housing 210. Thus, the first and second contact members 281 and 285 may be prevented from interfering with the wall W of the furniture F while the refrigerator 10 is being housed in the storage space Fs.

When the refrigerator 10 is housed in the storage space Fs of the furniture F, the user may stop the operation of the lever 250. The lever 250 moves forward due to the restoring force of the first elastic member 271 and by the operation of the first to third links 241, 242, and 243 and the second and third elastic members 272 and 273, the disk 230 is rotated and the first and second contact members 281 and 285 are drawn out of the housing 210 and are again in a position protruding from the housing side portion 213.

FIG. 14*b* illustrates a state where the first and second contact members 281 and 285 are protruded from the housing 210. The first and second contact members 281 and 285 protrude and contact the wall W of the furniture F. Due to such an operation, the refrigerator 10 may be stably installed in the furniture F in a state of being housed in the storage space Fs, thereby preventing movement thereof.

Hereinafter, other embodiments of the present invention will be described. Since these embodiments differ from the first embodiment only in the installation position of the contact mechanism or in a portion of the configuration, the differences will be mainly described, and for the same portions as in the first embodiment the description and reference numerals of the first embodiment may be used.

Figure 15:
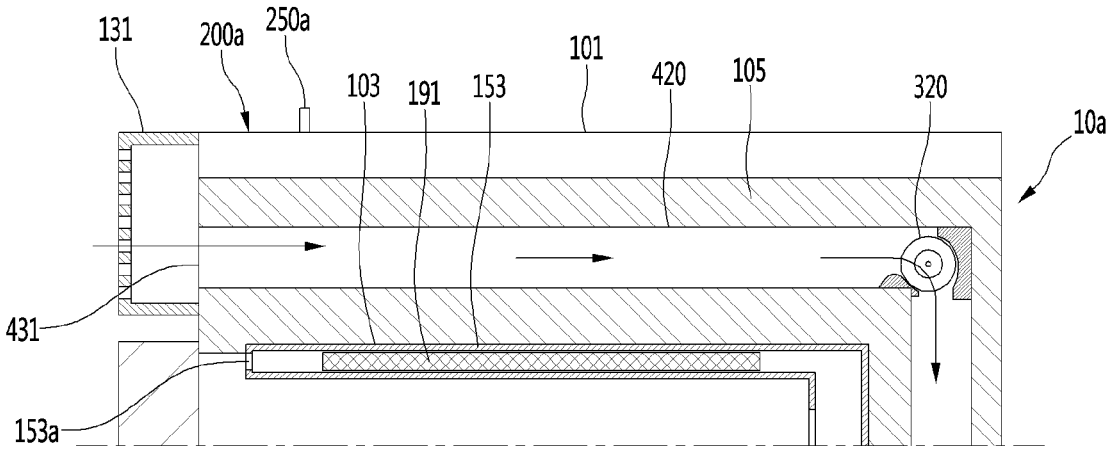
FIG. 15 is a view illustrating a configuration of a refrigerator according to a second embodiment of the present invention.

FIG. 15 is a view illustrating a configuration of a refrigerator according to a second embodiment of the present invention.

Referring to FIG. 15, the refrigerator 10*a* according to the second embodiment of the present invention includes a contact mechanism 200*a* installed inside the outer case 101. Specifically, the contact mechanism 200*a* may be positioned between the cabinet insulation material 105 and the outer case 101, which are disposed on an upper portion of the cabinet 100. Therefore, the outer case 101 may constitute a housing 210 (see FIG. 10) provided in the contact mechanism 200*a*.

The lever 250*a* provided at the upper portion of the contact mechanism 200*a* may protrude above the outer case 101. In addition, the description of the configuration of the contact mechanism 200*a* uses a description of the contact mechanism 200 according to the first embodiment.

According to this configuration, since the contact mechanism 200*a* is positioned inside the cabinet 100 of the refrigerator, the outer appearance of the refrigerator product may be made more pleasing.

Figure 16:
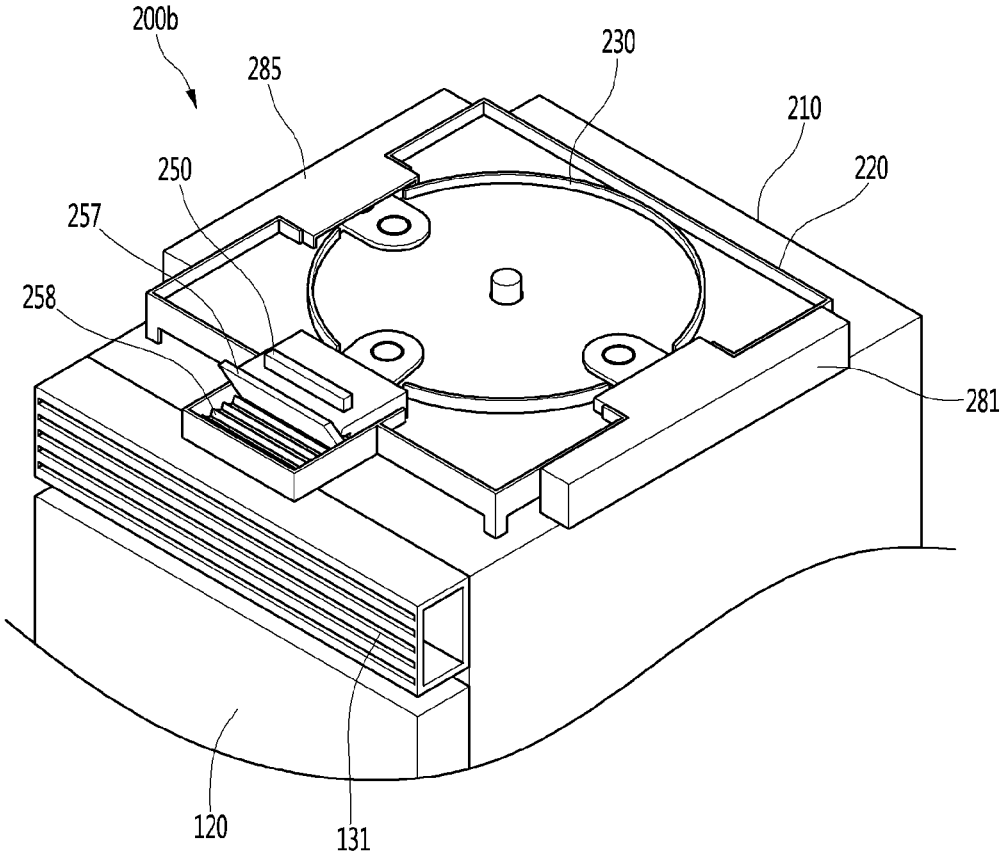
FIG. 16 is a view illustrating a configuration of a contact mechanism according to a third embodiment of the present invention.
Figure 17A:
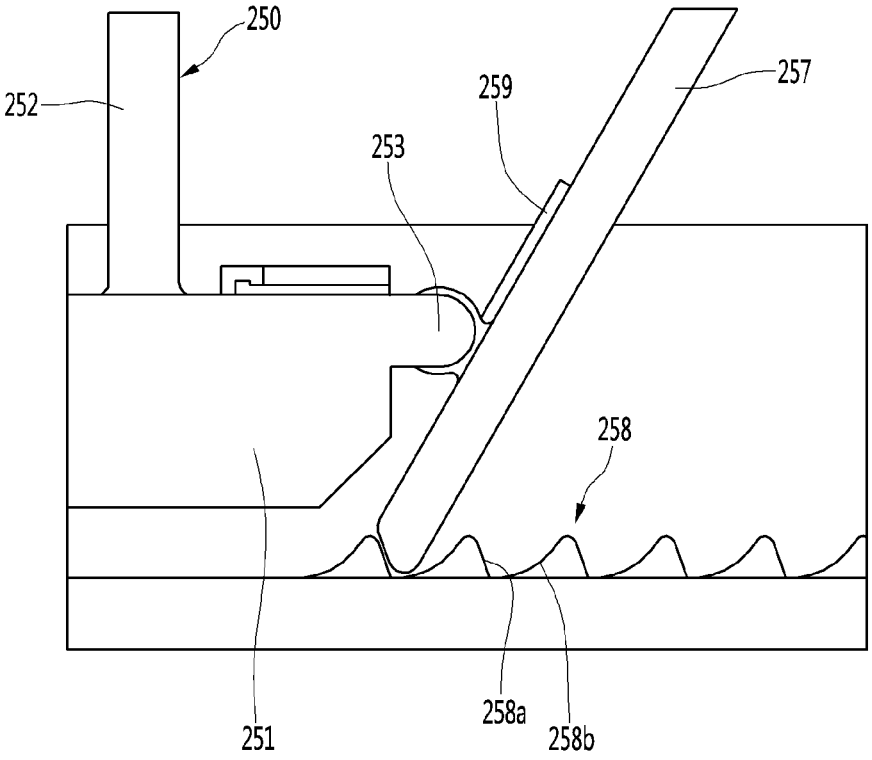
FIGS. 17*a* and 17*b* are views illustrating an operation of the contact mechanism according to the third embodiment of the present invention.
Figure 17B:
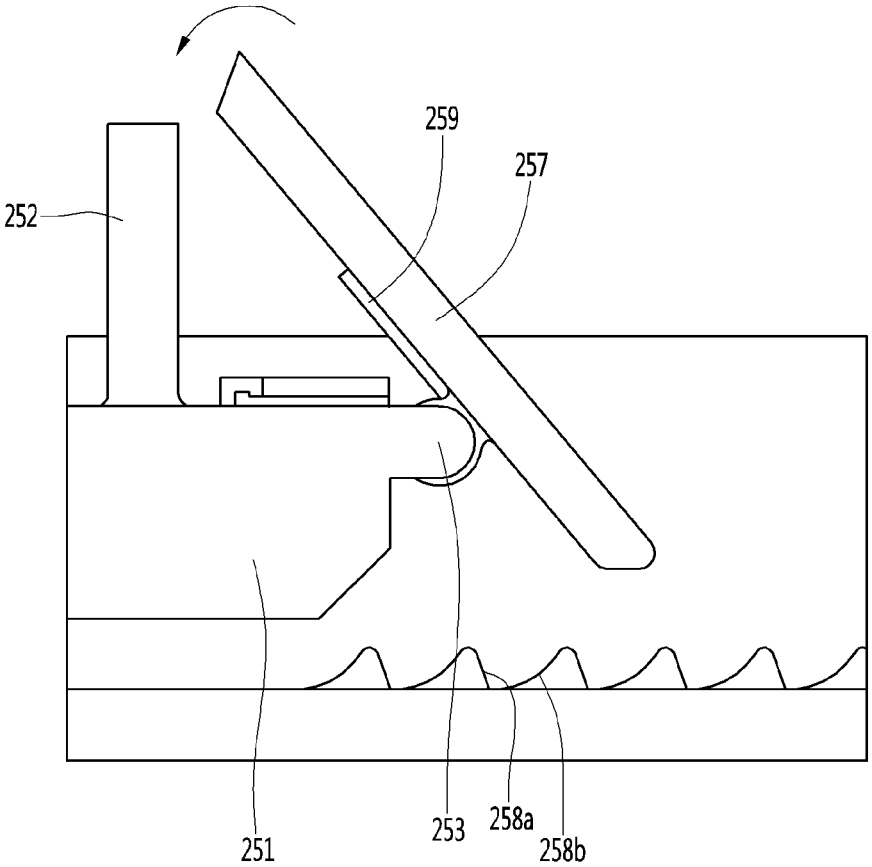

FIG. 16 is a view illustrating a configuration of a contact mechanism according to a third embodiment of the present invention, and FIGS. 17*a* and 17*b* are views illustrating an operation of the contact mechanism according to the third embodiment of the present invention.

Referring to FIG. 16, the compact mechanism 200*b* according to the third embodiment of the present invention includes the housing 210, the frame 220, the disk 230, the lever 250, and the first and second contact members 281 and 285.

The contact mechanism 200*b* further includes a stopper mechanism for preventing the lever 250 from being moved. The stopper mechanism includes an engaging member 257 and a rack 258.

In detail, the lever 250 includes a lever main body 251 linearly moving forward and backward and a handle 252 protruding upward from the lever main body 251 and capable of being held by the user.

The engaging member 257 may be coupled to a rear portion of the lever main body 251. The lever main body 251 is provided at an upper portion thereof with a rotation center portion 253 to which the engaging member 257 is rotatably engaged. The engaging member 257 may have a bar shape and may be elastically coupled to the rotation center portion 253.

The contact mechanism 200*b* further includes an engaging spring 259 which engages the engaging member 257 with the lever main body 251. For example, the engaging spring 259 may include a torsion spring. The engaging spring 259 may be coupled to a rear surface of the engaging member 257 and the rotation center portion 253.

Referring to FIG. 17*a*, a restoring force of the engaging spring 259 may be applied to the engaging member 257 in a state where the lever 250 is moved rearward. The upper portion of the engaging member 257 may be positioned behind the rotation center portion 253 and the lower portion of the engaging member 257 may be positioned forward of the rotation center portion 254.

The lower portion of the engaging member 257 may be engaged with the rack 258. The rack 258 may be positioned below the engaging member 257. In other words, due to the restoring force of the engaging spring 259, the engaging member 257 may receive a force in the rotating clockwise direction with respect to the rotation center portion 253.

The rack 258 may include a first guide surface 258*a* and a second guide surface 258*b* which extend obliquely with respect to the horizontal plane. The rack 258 may be configured such that the first and second guide surfaces 258*a* are alternately disposed. The lower portion of the engaging member 257 may be engaged between the first guide surface 258*a* and the second guide surface 258*b*.

The first guide surface 258*a* is positioned behind the second guide surface 258*b* and an inclined angle of the first guide surface 258*a* with respect to the horizontal plane can be formed larger than the inclined angle of the second guide surface 258*b* with respect to the horizontal plane.

According to this configuration, when the engaging member 257 and the rack 258 are in the engaged state, the engaging member 257 can be stably engaged with the first guide surface 258*a*. On the contrary, when the engaging member 257 is detached from the rack 258, the engaging member 257 may be smoothly rotated while moving along the second guide surface 258*b*.

FIG. 17*b* illustrates an operation when the lever 250 is moved backward. The user may release the engagement between the engaging member 257 and the rack 258 by rotating the engaging member 257 in the counterclockwise direction with respect to the rotation center portion 253. Then, the user may press the handle 252 or the engaging member 257 backward to move the lever 250 backward.

As the lever 250 moves backward, the first to third links 241, 242 and 243 act and the disk 230 rotates so that the first and second contact members 281 and 285 are drawn in the inside of the housing 210 in a manner as same as that of the first embodiment.

When the operation of the lever 250 is stopped after the refrigerator 10 is housed in the storage space Fs, the second and third elastic members 272 and 273 act so that the first and second contact members 281 and 285 protrude outside the housing side portion 213, and the lever 250 may be moved forward. When the operation of the engaging member 257 is stopped, the engaging member 257 rotates in the clockwise direction due to the restoring force of the engaging spring 259, and the lower portion of the engaging member 257 may be engaged with the rack 258.

By virtue of such operations, the first and second contact members 281 and 285 may be easily moved by the operation of the lever 250 and the engaging member 257 may be engaged with the rack 258, and thus the movement of the lever 250 may be prevented. As a result, the close contact state of the first and second contact members 281 and 285 may be effectively kept.

Figure 18A:
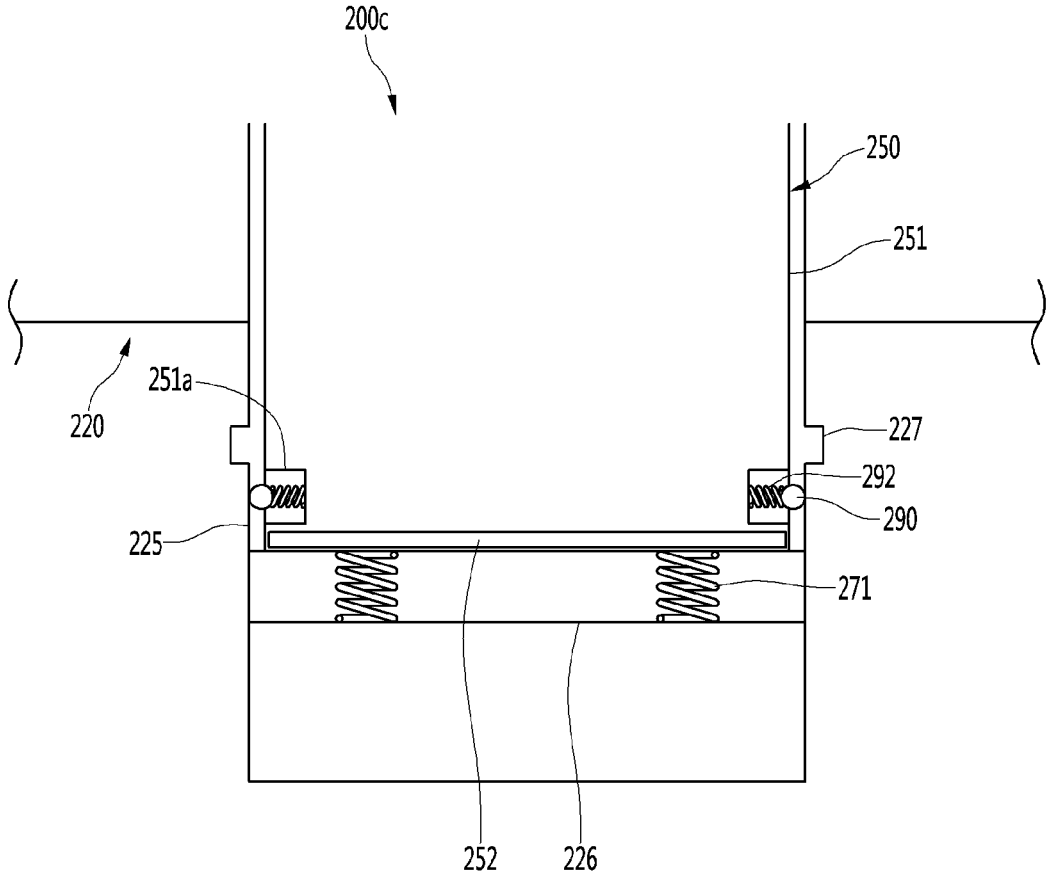
FIGS. 18*a* and 18*b* are views illustrating a configuration of a contact mechanism according to a fourth embodiment of the present invention.
Figure 18B:
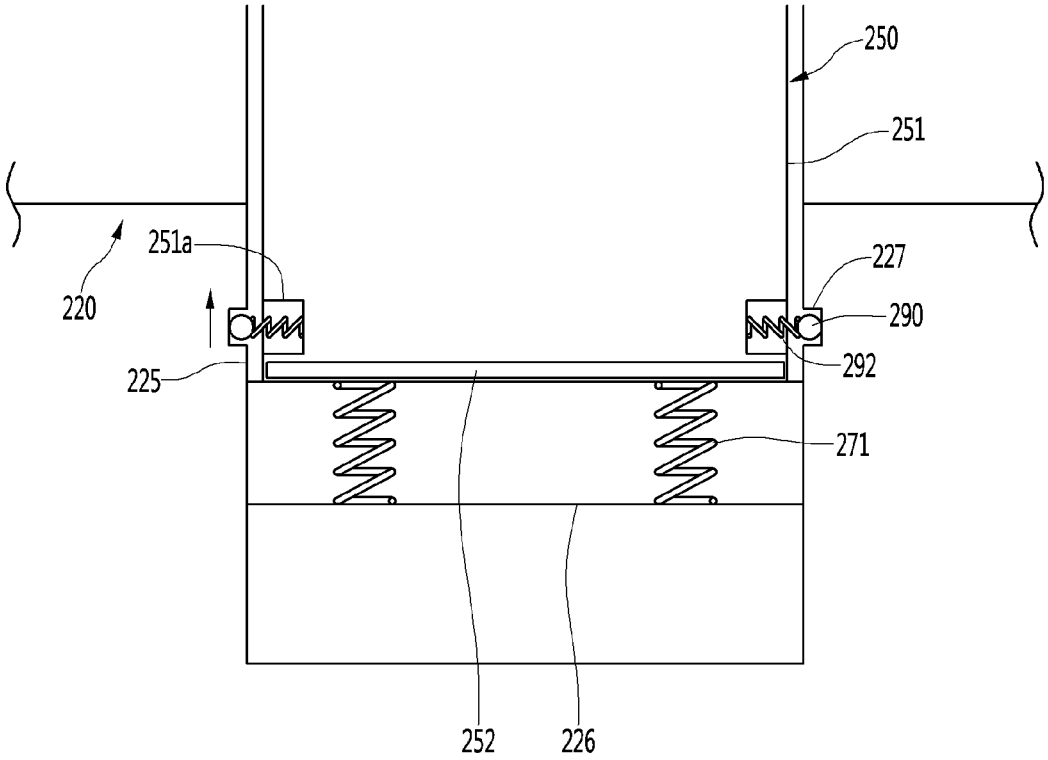

FIGS. 18*a* and 18*b* are views illustrating a configuration of a contact mechanism according to a fourth embodiment of the present invention.

Referring to FIGS. 18*a* and 18*b*, a contact mechanism 200*c* according to the fourth embodiment of the present invention includes a lever 250 having a lever main body 251 and a knob 252, a lever support 225 provided on both sides of the lever 250, a spring support jaw 226 connecting both lever supports 225, and a first elastic member 271 provided between the lever 250 and the spring support jaw 226. The description related to the first embodiment may be used for the description of these configurations.

The first to third links 241 and 243, the disk 230, the first and second contact members 281 and 285, and the second and third elastic members 272 and 273 described in the first embodiment are provided in the contact mechanism 200*c*, and thus, no further description is made with respect to these members.

As described in the first embodiment, the lever 250 may be linearly moved forward or backward between both lever supports 225.

The lever 250 may include stopper mechanisms 290 and 292 for limiting the movement of the lever 250. The stopper mechanisms 290 and 292 include a ball 290 and a ball spring 292 coupled to the ball 290 to provide a restoring force. For example, the ball spring 292 may include a compression spring.

The lever main body 251 includes an installation groove 251*a* in which the restriction mechanism is installed. The installation groove 251*a* may be formed by recessing the side surface of the lever main body 251. The ball spring 292 is coupled to the installation groove 251*a* and the ball 290 may protrude from the side surface of the lever main body 251 due to the restoring force of the ball spring 292.

The lever support 225 is formed with an engaging groove 227 into which at least a portion of the ball 290 is inserted. The engaging groove 227 may be positioned behind the installation groove 251*a* in a state where the refrigerator 10 is installed in the storage space Fs of the furniture F.

When the ball 290 is positioned at the side of the engaging groove 227 in the process of moving the lever 250 backward, the ball 290 may be engaged in the engaging groove 227.

The operation of the restriction mechanisms 290 and 292 will be briefly described.

FIG. 18*a* illustrates a position of the lever 250 when no external force is applied to the lever 250. At this time, the lever 250 may be positioned relatively forward. In other words, the lever 250 may be positioned relatively close to the spring support jaw 226 by the restoring force of the first elastic member 271. The ball 290 is pushed by the lever support 225 and is positioned inside the installation groove 251*a*.

Meanwhile, in a state of FIG. 18*a*, when the user moves the lever 250 rearward, the ball 290 slides rearward along the lever supports 225. In this state, when the ball 290 is positioned on the side of the engaging groove 227, the ball 290 protrudes from the side surface of the lever main body 251 and at least a portion of the ball 290 may be inserted into the engaging groove 227 (see FIG. 18*b*).

In a state of FIG. 18*b*, as described in the first embodiment, the first and second contact members 281 and 285 are drawn in the house 210 by the operation of the links 241 and 243 and the disk 230 interlocked with the lever 250. In addition, since the ball 290 is engaged with the engaging groove 227, the movement of the lever 250 forward may be restricted.

As a result, in the state where the ball 290 is engaged with the engaging groove 227 by moving the lever 250 backward, the user may remove the hand from the lever 250, and thus may conveniently house the refrigerator in the storage space Fs. In other words, it is not necessary to hold the lever 250 continuously until the refrigerator 10 is housed.

When the ball 290 is removed from the engaging groove 227 by pulling the lever 250 in a state where the refrigerator 10 is housed in the storage space Fs, the lever 250 may be moved forward by the restoring force of the elastic member 271 and the second and third elastic members 272 and 273. The first and second contact members 281 and 285 protrude from the housing side portion 213 and may be brought into contact with the wall W of the furniture F.

Figure 19:
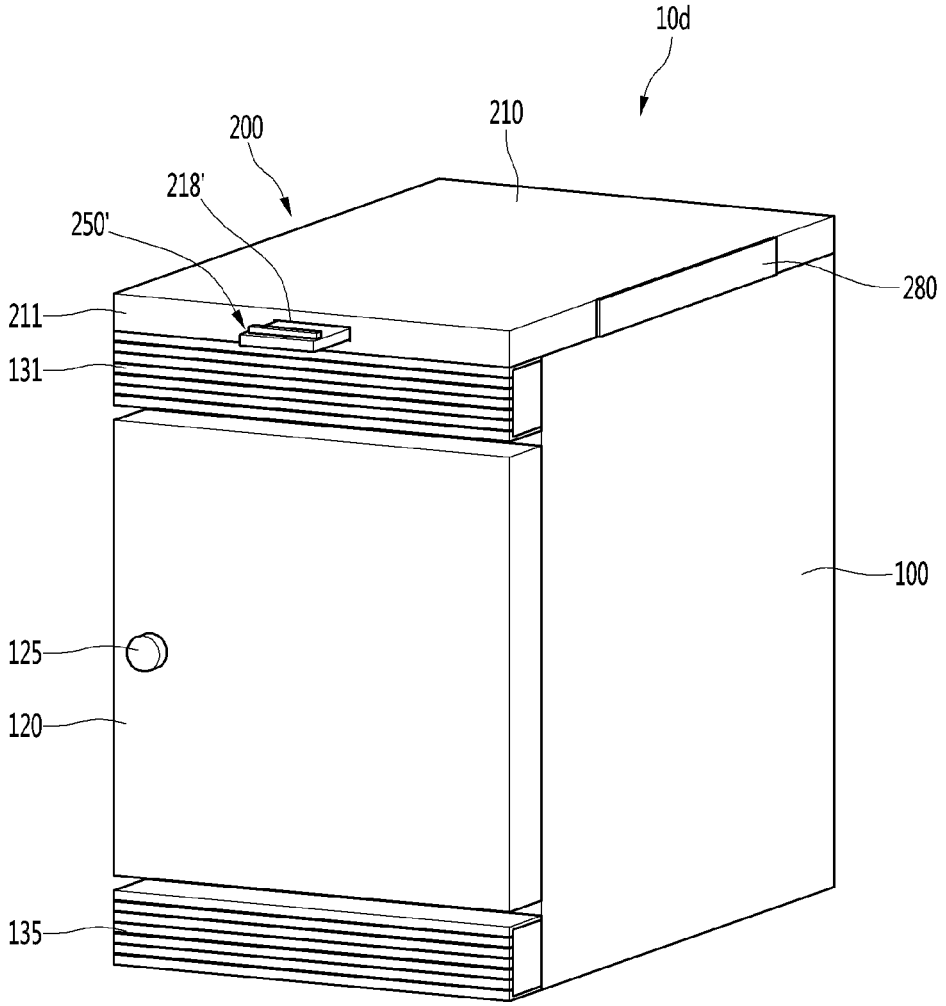
FIG. 19 is a view illustrating a configuration of a refrigerator according to a fifth embodiment of the present invention.

FIG. 19 is a view illustrating a configuration of a refrigerator according to a fifth embodiment of the present invention. The fifth embodiment may use the constituent elements described in the first embodiment, however the installation position of the lever is different from that of the first embodiment.

Referring to FIG. 19, the refrigerator 10*d* according to the fifth embodiment of the present invention includes a lever 250' installed on the housing front portion 211. The housing front portion 211 is formed with a cutout portion 218' into which the lever 250' is inserted.

The lever 250' may protrude forward from the housing front portion 211. In addition, the lever 250' may move backward and draw into the housing 210.

The first to third links 241 and 243, the disk 230, the first and second contact members 281 and 285, and the first to third elastic members 271, 272, and 273 described in the first embodiment are included in the rear of the lever 250' and thus, no further description is made with respect to these members.

When the user moves the lever 250' backward, by the operation of the first to third links 241 and 243 and the disk 230, the first and second contact members 281 and 285 may be drawn into the housing 210.

When the operation of the lever 250' is stopped, the lever 250' is moved forward by the restoring forces of the first to third elastic members 271, 272 and 273, and the first and second contact member 281 and 285 may be drawn out to the outside of the housing 210, by the operation of the first to third links 241 and 243 and the disk 230.

According to the configuration and operation of this embodiment, user convenience is enhanced and the refrigerator 10*d* may be stably installed in the storage space Fs of the furniture F without shaking.

What is claimed is:

1. A refrigerator capable of being installed in a storage space defined by a wall of an object, the refrigerator comprising:

a cabinet including an inner case which forms a storage chamber, an outer case which surrounds the inner case, and a cabinet insulation material which is disposed between the inner case and the outer case;

a door which is disposed in front of the cabinet, the door to open and close the storage chamber;

a supply duct which is installed at the inner case, the supply duct to discharge cool air to the storage chamber;

a cool air circulation fan which is installed at one side of the supply duct, the cool air circulation fan to generate circulation of the cool air; and a contact mechanism which is provided at one side of the outer case, wherein the contact mechanism includes a lever which is movably provided, a disk which rotates according to a movement of the lever, and a contact member which moves based on rotation of the disk for contact with the wall of the object.

2. The refrigerator of claim 1, wherein the contact mechanism is disposed on an upper side of the cabinet.

3. The refrigerator of claim 1, wherein the contact mechanism further includes a housing in which the disk is installed, and an insertion portion formed on the housing and in which the contact member is drawn in or drawn out.

4. The refrigerator of claim 3, wherein the housing includes a housing front portion and a housing side portion which is provided on both sides of the housing front portion, and wherein the insertion portion is formed on the housing side portion.

5. The refrigerator of claim 4, wherein the housing further includes a housing upper portion which is connected to the housing side portion, and wherein the lever is disposed on the housing upper portion or the housing front portion.

6. The refrigerator of claim 1, further comprising:

a link which is rotatably provided so as to be interlocked with the movement of the lever.

7. The refrigerator of claim 6, wherein the link includes:

a first link to connect the lever and the disk.

8. The refrigerator of claim 7, wherein the link further includes:

a second link to connect the disk and the contact member.

9. The refrigerator of claim 1, further comprising:

a first elastic member which is coupled to the lever to provide restoring force.

10. The refrigerator of claim 9, further comprising:

a second elastic member which is coupled to the contact member to provide restoring force.

11. The refrigerator of claim 1, wherein the lever linearly moves forward or backward, and wherein the contact member protrudes from a housing in a lateral direction based on the movement of the lever.

12. The refrigerator of claim 1, wherein the contact mechanism is installed within the outer case.

13. The refrigerator of claim 1, wherein the contact mechanism further includes a stopper mechanism to restrict the movement of the lever.

14. The refrigerator of claim 13, wherein the stopper mechanism further includes:

an engaging member which is rotatably coupled to the lever; and a rack to be engaged with the engaging member.

15. The refrigerator of claim 14, wherein the contact mechanism further includes:

a torsion spring which is coupled to the engaging member and the lever.

16. The refrigerator of claim 13, wherein the stopper mechanism includes:

a ball; and a ball spring which is coupled to the ball to provide a restoring force.

17. The refrigerator of claim 16, further comprising:

a lever support which is provided on both sides of the lever to guide the movement of the lever; and an engaging groove which is recessed in the lever support and into which at least a portion of the ball is inserted.

18. The refrigerator of claim 1, further comprising:

a thermoelectric device module installed at a rear wall of the storage chamber, the thermoelectric device module including an endothermic heat sink exchanging heat with the cool air and an exothermal heat sink exchanging heat with outdoor air.

19. The refrigerator of claim 1, further comprising:

a cold storage agent which is installed in the supply duct and cooled by the cool air flowing through the supply duct.

20. The refrigerator of claim 1, further comprising:

a heat dissipating duct which is installed at the cabinet insulation material, the heat dissipating duct to introduce or discharge outdoor air; and a heat dissipating fan which is installed at one side of the heat dissipating duct, the heat dissipating fan to generate a flow of the outdoor air.

* * * * *